US012736035B2

(12) United States Patent
Burguieres

(10) Patent No.: US 12,736,035 B2
(45) Date of Patent: Sep. 15, 2026

(54) FLUID END BLOCK AND FLUID END FOR A MULTIPLEX PISTON PUMP HAVING MULTIPLE INLET PASSAGES

(71) Applicant: Philip Martial Burguieres, Houston, TX (US)

(72) Inventor: Philip Martial Burguieres, Houston, TX (US)

( * ) Notice: Subject to any disclaimer, the term of this patent is extended or adjusted under 35 U.S.C. 154(b) by 0 days.

(21) Appl. No.: 19/541,742

(22) Filed: Feb. 17, 2026

(65) Prior Publication Data

US 2026/0243239 A1 Aug. 20, 2026

Related U.S. Application Data

(63) Continuation-in-part of application No. 17/964,729, filed on Oct. 12, 2022, now abandoned.

(60) Provisional application No. 63/285,269, filed on Dec. 2, 2021.

(51) Int. Cl.

| | |
|---|---|
| ***F04B 1/053*** | (2020.01) |
| ***F04B 1/0421*** | (2020.01) |
| ***F04B 23/06*** | (2006.01) |
| ***F04B 53/00*** | (2006.01) |
| ***F04B 53/10*** | (2006.01) |
| ***F04B 53/16*** | (2006.01) |
| *E21B 43/26* | (2006.01) |
| *F04B 15/02* | (2006.01) |

(52) U.S. Cl.

CPC ..... *F04B 1/053* (2013.01); *F04B 1/0421* (2013.01); *F04B 23/06* (2013.01); *F04B 53/007* (2013.01); *F04B 53/10* (2013.01); *F04B 53/162* (2013.01); *E21B 43/2607* (2020.05); *F04B 15/02* (2013.01); *F04B 53/006* (2013.01); *F04B 53/16* (2013.01)

(58) Field of Classification Search

CPC ..... F04B 1/0421; F04B 1/053; F04B 23/06; F04B 53/006; F04B 53/007; F04B 53/10; F04B 53/16; F04B 53/162; F04B 15/02; E21B 43/2607

See application file for complete search history.

(56) References Cited

U.S. PATENT DOCUMENTS

| | | | | |
|---|---|---|---|---|
| 3,702,624 | A * | 11/1972 | Fries | F04B 53/109 137/516.23 |
| 11,513,024 | B2 * | 11/2022 | Rogers | G01M 3/26 |
| 12,366,243 | B1 * | 7/2025 | Stephenson | F04B 51/00 |
| 2005/0207904 | A1 * | 9/2005 | Kouno | F04D 13/14 417/247 |
| 2019/0154033 | A1 * | 5/2019 | Brooks | F16K 15/026 |
| 2025/0320802 | A1 * | 10/2025 | Warren | B01F 23/581 |

* cited by examiner

*Primary Examiner* — Charles G Freay
(74) *Attorney, Agent, or Firm* — Jeffrey L. Streets

(57) ABSTRACT

A fluid end block, a pump including the fluid end block and a method of forming a mixed fluid stream are provided. The fluid end block includes linear bores forming piston chambers, cross bores, first and second inlet bores and at least one outlet bore. The first and second inlet bores may be separate blind bores. The pump may draw a first fluid via the first inlet bore and a second fluid via the second inlet bore, then output a mixed fluid via the at least one outlet bore. The mixed fluid contains a ratio of the first and second fluids according to the number of piston chambers that are in fluid communication with the first inlet bore and the second inlet bore, respectively.

20 Claims, 13 Drawing Sheets

FLUID END BLOCK AND FLUID END FOR A MULTIPLEX PISTON PUMP HAVING MULTIPLE INLET PASSAGES

CROSS-REFERENCE TO RELATED APPLICATIONS

This application is a continuation-in-part of U.S. Non-provisional patent application Ser. No. 17/964,729 filed on Oct. 12, 2022, now abandoned, which claims priority to U.S. Provisional Patent Application No. 63/285,269 filed on Dec. 2, 2021, which applications are both incorporated by reference herein.

BACKGROUND

The present disclosure relates to a fluid end block and fluid end for a multiplex piston pump.

BACKGROUND OF THE RELATED ART

A piston pump is a type of positive displacement pump where a high-pressure seal reciprocates with movement of the piston. Piston pumps may be used to move liquids or compress gases. These pumps can operate over a wide range of pressures and high-pressure operation can be achieved without a strong effect on flow rate. Piston pumps can also deal with viscous media and media containing solid particles.

Reciprocating piston pumps move the fluid using one or more oscillating pistons, plungers, or membranes (diaphragms), while inlet (i.e., input or intake) and outlet (i.e., output or discharge) valves restrict fluid motion to the desired direction. In order for suction to take place, the pump must first pull the piston in an outward motion or stroke to decrease pressure in a piston chamber. The low pressure in the piston chamber will cause the outlet valve to close and the input valve to open, such that a fluid provided at the input is drawn into the piston chamber. When the piston subsequently pushes in an inward motion or stroke, the piston will increase the pressure within the piston chamber. The high pressure in the piston chamber will cause the inlet valve to close and the outlet valve to open, such that the fluid within the piston chamber is expelled out of the piston chamber.

Multi-piston pumps are one of the most common types of pumps utilized in industry. Pistons in these pumps are driven in unison. For example, the pistons may be attached to a common crankshaft and energized by a motor (diesel, electric or hydraulic). Multi-piston pumps may be delineated by the number of piston chambers/pistons included in the pump. A duplex pump has two piston chambers (cylinders) and a triplex pump has three piston chambers (cylinders). Quadruplex and quintuplex pumps have 4 and 5 piston chambers/pistons, respectively, and are also common. These pumps can also be "single-acting" with suction during one direction of piston motion and discharge during the other direction of piston motion, or "double-acting" with suction and discharge in both directions. The oil and gas industry commonly utilizes triplex and quadruplex pumps because of their robust construction, long service life and ability to pump large volumes of fluids at high pressures.

FIG. 1A is a cross-sectional diagram of a piston chamber 12 of a piston pump 10, where the piston chamber 12 includes a piston 14 coupled to a crank shaft 16, an input or suction valve 18 for drawing fluid into the piston chamber 12 from an input or supply conduit 20, and an output or discharge valve 22 for driving fluid out of the piston chamber 12 into an output or discharge conduit 24. The input valve 18 is a unidirectional valve (check valve) that separates the piston chamber 12 from an input conduit 20 and is configured and oriented to open when the pressure in the input conduit 20 is greater than the pressure in the piston chamber 12 and close when the pressure in piston chamber 12 is greater than the pressure in the input conduit 20. Similarly, the output valve 22 is a unidirectional valve (check valve) that separates the piston chamber 12 from an output conduit 24 and is configured and oriented to open when the pressure in piston chamber 12 is greater than the pressure in the outlet conduit 24 and close when the pressure in the outlet conduit 24 is greater than the pressure in the piston chamber 12.

As the crankshaft 16 is driven to rotate about its axis 26, a radially offset journal 28 travels in a circular path about the axis 26. A connecting rod 30 has a first end pivotally coupled to the journal 28 and a second end pivotally coupled to a connector 32 on the bottom of the piston 14. Accordingly, as the journal 28 follows the circular path around the axis 26, the piston 14 is caused to move upward and downward within the piston chamber 12. As the piston 14 is moving downward, the volume above the piston 14 increases and the pressure above the piston 14 decreases. The low pressure above the piston 14 allows the output valve 22 to close and causes the input valve 18 to open. Therefore, fluid in the input conduit 20 is drawn into the piston chamber 12. With continued rotation of the crankshaft 16, the piston 14 is then caused to move upward to reduce the volume above the piston 14 and increase the pressure in the piston chamber 12. The high pressure above the piston 14 allows the input valve 18 to close and causes the output valve 22 to open, such that fluid within the piston chamber 12 is forcibly discharged into the output conduit 24. Controlling the rate at which the crankshaft 16 is rotated will control the rate at which fluid is moved from the input conduit 20 to the output conduit 24.

FIG. 1B is a schematic diagram of the piston pump 10 having three piston chambers 12 and three corresponding pistons 14 consistent with FIG. 1A. The piston chamber 12 of FIG. 1A may be one of the three piston chambers 12 of FIG. 1B. The illustration of the piston pump 10 in FIG. 1B is turned 90 degrees from the illustration in FIG. 1A, such that the axis 26 of the crankshaft 16 extends left-to-right rather than in-and-out of the page.

Each piston chamber 12 illustrates the input valve 18 that separates the piston chamber 12 from an input conduit on one side of the piston pump 10. The output valves 22 (not shown) are located on the opposite side of the piston chamber 12 from the input valves 18. The operation of each piston 14 is the same as described in reference to FIG. 1A. However, the illustration in FIG. 1B shows how the operation of three pistons 14 is coordinated. Each of the piston chambers 12 may be formed identically and each of the pistons 14 may be operated identically, except for the connection of the respective connecting rods 30 to the crankshaft 16. Specifically, the connecting rod 30 of the left-most piston 14 is connected to a first journal 34, the connecting rod 30 of the center piston 14 is connected to a second journal 36, and the connecting rod 30 of the right-most piston 14 is connected to a third journal 38. The journals 34, 36, 38 are each radially offset from the axis 26 and will rotate with the crankshaft 16, but the journals 34, 36, 38 are angularly spaced about the axis 26. For example, with three pistons 14, the journals 34, 36, 38 may be angularly spaced part by about a 120-degree angle about the axis 26. As illustrated, the left-most journal may be directed out of the page such that the corresponding piston 14 is in the middle of its stroke, the center journal may be directed up and back of the page such that the corresponding piston 14 is near (but perhaps not quite at) the top dead center of its stroke, and the right-most journal may be directed down and back of the page such that the corresponding piston 14 is near (but perhaps not quite at) the bottom dead center of its stroke. Although the stroke of each piston 14 may have a unique timing, the motor 40 may rotate the crankshaft 16 and cause all three pistons 14 to pump fluid from the inlet valve to the outlet valve of the piston chamber 12 in which the individual piston 14 operates.

FIG. 1C is a schematic diagram of the triplex piston pump 10 of FIG. 1B illustrating the flow of fluid from an input manifold 20 to an output manifold 24. Driving the three pistons (not shown) back and forth in the three piston chambers 12 will take fluid from the input manifold 20 and displace it into the output manifold 24 under pressure. By having three piston chambers 12, each of the pistons (not shown) may be coupled to a crankshaft and timed to offset the strokes of the three pistons. For example, each piston may perform a fluid compression stroke at a different time, such as evenly spaced intervals before repeating the strokes. This reduces the peak load on the motor and produces a more even distribution of fluid flow into and out of the pump.

BRIEF SUMMARY

Some embodiments provide a pump comprising a pump body including multiple piston chambers, each piston chamber including a piston, an inlet valve and an outlet valve. The pump further comprises a first input conduit in fluid communication with the inlet valve of each of a first subset of the piston chambers, a second input conduit in fluid communication with the inlet valve of each of a second subset of the piston chambers, and one or more output conduit in fluid communication with the outlet valve of each of the piston chambers.

Some embodiments provide a method of forming a mixed fluid stream. The method comprises supplying a first fluid to a first subset of piston chambers in a pump having multiple piston chambers, supplying a second fluid to a second subset of piston chambers in the pump having multiple piston chambers, operating the pump to discharge the first fluid through the first subset of piston chambers and discharge the second fluid through the second subset of piston chambers, and combining the first fluid discharged from the first subset of piston chambers with the second fluid discharged from the second subset of piston chambers to form the mixed fluid stream.

Some embodiments provide an apparatus comprising a fluid end block. A first set of multiple linear bores are directed through the fluid end block in a primary direction, wherein each of the linear bores in the first set form a piston chamber. A second set of multiple linear bores are directed through the fluid end block in a lateral direction, wherein each of the linear bores in the second set form a cross bore that intersects with one of the piston chambers, and wherein each cross bore has a fluid inlet end and a fluid outlet end. In addition, one or more outlet bores are directed into the fluid end block in a longitudinal direction, wherein the fluid outlet end of each cross bore is intersected by one of the outlet bores. A first inlet bore is directed into the fluid end block in the longitudinal direction from a first end of the fluid end block, wherein the first inlet bore is a first blind bore that intersects with the fluid inlet end of a first subset of the cross bores. A second inlet bore is directed into the fluid end block in the longitudinal direction from a second end of the fluid end block that is opposite the first end of the fluid end block, wherein the second inlet bore is a second blind bore that intersects with the fluid inlet end of a second subset of the cross bores, and wherein a portion of the fluid end block separates a bottom end of the first blind bore and a bottom end of the second blind bore. Still further, the apparatus comprises a plurality of inlet valve assemblies including, for each piston chamber, one of the inlet valve assemblies secured within the fluid inlet end of the cross bore that intersects with the piston chamber to allow one-way fluid flow into the piston chamber, and a plurality of outlet valve assemblies including, for each piston chamber, one of the outlet valve assemblies secured within the fluid outlet end of the cross bore that intersects with the piston chamber to allow one-way fluid flow out of the piston chamber.

DETAILED DESCRIPTION

Figure 1A:
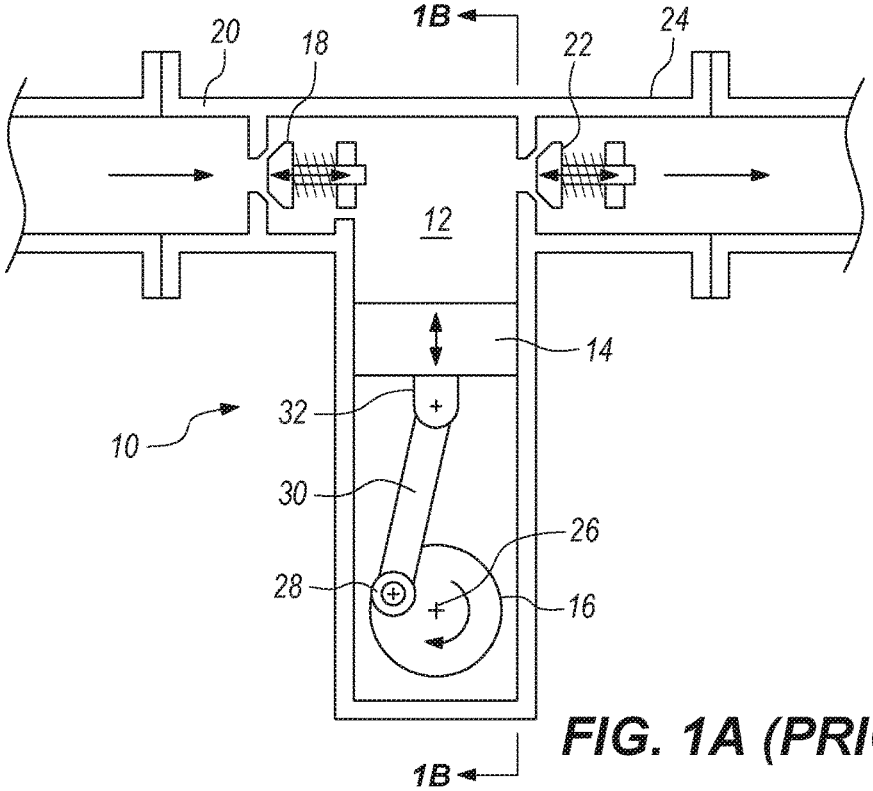
FIG. 1A (PRIOR ART)
FIGS. 1A-B are diagrams of a prior art triplex piston pump having three piston chambers and three corresponding pistons for moving fluid from a common input manifold to a common output manifold.

Some embodiments provide a pump comprising a pump body including multiple piston chambers, each piston chamber including a piston, an inlet valve and an outlet valve. The pump further comprises a first input conduit in fluid communication with the inlet valve of each of a first subset of the piston chambers, a second input conduit in fluid communication with the inlet valve of each of a second subset of the piston chambers, and one or more output conduit in fluid communication with the outlet valve of each of the piston chambers.

In some embodiments, the multiple piston chambers may have any number of piston chambers, such as range from 2 to 5 piston chambers, without limitation. Each piston chamber will have a piston that is mechanically driven to reciprocate within the piston chamber. For example, each piston may have a connector that is pivotally connected to a first end of a connecting rod. The second end of the connecting rod may be pivotally connected to an offset journal of a crank shaft. A motor may be turned as a controlled speed (i.e., rotations per minute, RPMs) to cause the piston to reciprocate back and forth within the piston chamber at a rate proportional to the speed of the motor. Each piston then goes through a suction or intake stroke moving away from the valves and then a compression or discharge stroke moving toward the valves. The flow of fluid into and out of the piston chamber above the piston is controlled by the valves, which serve as check valves. Accordingly, the inlet valve only allows fluid into the piston chamber during a suction or intake stroke and the outlet valve only allows fluid out of the piston chamber during a compression or discharge stroke. A separate connecting rod to each piston may be pivotally coupled to the same crank shaft, but the point of connection the crank shaft is typically offset by an angle of rotation so that the compression or discharge strokes of each piston do not occur at the same time and are preferably equally angularly offset about an axis of the crank shaft.

In some embodiments, the pump may be characterized in that a ratio of an amount of fluid pumped from the first input conduit to an amount of fluid pumped from the second input conduit is a function of a first number of the piston chambers in the first subset (which are in fluid communication with the first input conduit) and a second number of piston chambers in the second subset (which are in fluid communication with the second input conduit). However, the ratio of fluid amounts pumped from the first and second conduits may be a function of, or affected by, the pressure in the first and second inlet conduits and the pressure in the one or more outlet conduit. Furthermore, where the first input conduit is coupled to a first fluid source and the second input conduit is coupled to a second fluid source, the ratio of the amount of the first fluid pumped from the first conduit to the amount of the second fluid pumped from the second conduit may also be a function of, or affected by, the viscosities of the first and second fluids. The exact ratio of first and second fluids passing through the pump may be empirically determined. In applications where the exact ratio is critical, it is an option to modify the composition and/or viscosity of the first fluid source and/or the second fluid source.

In some embodiments, the one or more output conduit is a single output manifold that is in fluid communication with the outlet valve of each of the piston chambers in the pump body. Accordingly, fluid output from the multiple piston chambers into the single output manifold may include a mixture of a first fluid from the first input conduit and a second fluid from the second input conduit. For example, the mixture may be characterized by a predetermined ratio of an amount of the first fluid to an amount of the second fluid that is a function of, or affected by, a ratio of a first number of the piston chambers in the first subset and a second number of piston chambers in the second subset. For example, the mixture may be characterized by a predetermined ratio of an amount of the first fluid to an amount of the second fluid that is equal to, or substantially equal to, a ratio of a first number of the piston chambers in the first subset and a second number of piston chambers in the second subset. The first and second fluids may the same fluid or different fluids.

Many processes require that two or more fluids be mixed at precise ratios to ensure a particular designed effect. Common mix ratios of two separate fluids include mix ratios of 1:1, 2:1 or 3:1 ratio or other fixed mixing ratios. Depending upon the purpose of the mixing, such as a combination of reactants to cause a chemical reaction, accurately achieving a prespecified mix ratio may range from important to critical. In fact, achieving a desired mix of two or more fluids may be performed as a preliminary step before introducing the mixed fluids into a process or location where the mixed fluid will be utilized. For example, a two-part epoxy formulation would typically be mixed in a tank until the quantity of each part was verified and the mixing was determined to be thorough. Then, the mixed epoxy composition would be pumped out of the tank to a desired location, such as into an oil well or gas well.

Embodiments of the multi-piston pump disclosed herein provide the ability to accurately pump different fluids at exact ratios without pre-mixing those fluids. Rather, two or more fluids may be accurately mixed in real-time during pumping of the fluids. This provides a technical benefit in that the fluids are not mixed until they are being pumped into a process or location. Another technical benefit is that the piston chambers may, in some embodiments, never contain the mixture of fluids. This may mean that the physical properties of the separate fluids being pumped are more stable and easier to handle than the physical properties of the mixed fluids. Furthermore, the expense, process time and cleanup of dedicated mixing equipment is avoided. Still further, some embodiments of the multi-piston pumps disclosed herein are able to pump multi-component fluids at high volumes, such as from 10 to 500 or more gallons per minute (gpm), and high pressure, such as from 100 to 10,000 or more pounds per square inch (psi), in reliable fixed ratios and/or quantities.

The configuration of multiple input conduits or manifolds, and perhaps also multiple output conduits or manifolds, for the multi-piston pumps allows for the pumps to provide fixed metering of multiple fluids at high flows and pressures. Each piston chamber (cylinder) in a multi-piston pump may have the same dimension and configuration. Accordingly, as each piston completes a stroke, a consistent and identical volume of fluid is taken in, compressed and expelled. If a multi-component fluid mixture requires a 2:1 ratio, then the input manifold of a triplex (three-piston chamber) pump would be replaced with a first input conduit or manifold configured to supply component A into two piston chambers (i.e., a first piston chamber and a second piston chamber) and a second input conduit or manifold configured to supply component B into one piston chamber (i.e., a third piston chamber). Each complete rotation of the pump crankshaft would produce an output fluid stream having volumetric ratio of 2 parts A to 1 part B.

Some embodiments may provide pumps over a range of numbers of piston chambers and a range of numbers of input and output conduits or manifolds. In a first example, the first and second piston chambers of a duplex pump may each be directed to one of two input conduits to form a mixture of first and second fluids at a ratio of 1:1. In a second example, the three piston chambers of a triplex pump may be directed to 2-3 input conduits or manifolds to form a mixture of two fluids at a ratio of 2:1 or to form a mixture of three fluids at a ratio of 1:1:1. In a third example, the four piston chambers of a quadruplex pump may be directed to 2-4 input conduits or manifolds to form a mixture of two fluids at a ratio of 1:1 (i.e., 2 fluids to each of two inlet manifolds) or 3:1 or to form a mixture of four fluids at a ratio of 1:1:1:1. In a fourth example, the five piston chambers of a quintuplex pump may be directed to 2-5 input conduits or manifolds to form a mixture of two fluids at a ratio of 4:1 or 3:2, to form a mixture of three fluids at a ratio of 2:2:1 or 3:1:1, to form a mixture of four fluids at a ratio of 2:1:1:1, or to form a mixture of five fluids at a ratio of 1:1:1:1:1.

In some embodiments, the one or more output conduits include a first output conduit and a second output conduit, wherein the first output conduit is in fluid communication with the outlet valve of each of the first subset of the piston chambers, and wherein the second output conduit is in fluid communication with the outlet valve of each of the second subset of the piston chambers. The operation of the pump may be characterized in that a ratio of a first amount of fluid pumped from the first input conduit into the first output conduit to a second amount of fluid pumped from the second input conduit into the second output conduit is a function of, or affected by, a ratio of a first number of the piston chambers in the first subset to a second number of piston chambers in the second subset. The first and second fluids may be the same fluid or different fluids, but the first and second fluids are kept separate from each other as they pass through the respective input conduits, piston chambers and output conduits. Having separate flow paths into, through, and out of the pump prevents mixing of the first and second fluids within the pump.

In some embodiments, the system may further include a mixing chamber or device, such as an inline mixer, in fluid communication with the first output conduit and the second output conduit for receiving and mixing a first fluid from the first output conduit and a second fluid from the second output conduit. An inline mixer may be either active or passive, where the later is sometimes referred to as a static mixer. An advantage of using a mixing chamber or device coupled to first and second output conduits rather than having a single output conduit or manifold is that the mixing of the first and second fluids may occur at a selected location that is some distance from the pump. A fluid that is pumped through a conduit at a given flow rate over a particular distance will have a determinable residence time within the conduit. Depending upon the dynamics of a particular application for pumping the first and second fluids, a particular residence time may be beneficial while other residences times may be detrimental. For example, in applications where the first fluid includes a first reactant, the second fluid includes a second reactant that is reactive with the first reactant, and the reactions between the first and second reactants forms a solid material, then it may be beneficial to transport the first and second fluids in separate first and second conduits until any remaining residence time in the conduit(s) is less than the amount of time for the first and second reactants to form a solid.

In some embodiments, the system may include a source of a first fluid connected to the first input conduit to supply the first fluid to the inlet valve of each of the first subset of the piston chambers, and a source of a second fluid connected to the second input conduit to supply the second fluid to the inlet valve of each of the second subset of the piston chambers. Optionally, the first fluid may include an epoxy resin and the second fluid may include a hardener that reacts with the epoxy resin to form a solid. Some embodiments may provide the technical benefit of enabling the compositions of the first and second fluids to be optimized for forming a solid with the desired physical properties, rather than having the compositions of the first and second fluid be dictated by reaction dynamics that must be slowed or retarded so that the mixed reactants will not solidify while they are still in the conduit (i.e., during the residence time). A further technical benefit of some embodiments is that any interruption in the pumping process, such as a loss of electrical power to the pump, simply delays the mixing of the first and second fluids, rather than leaving the mixed reactants to solidify within the conduit.

In some embodiments, the system may also include a coiled tubing injector for controllably extending concentric tubing into a well, wherein the first output conduit is coupled to a first channel within the concentric tubing and the second output conduit is coupled to a second channel within the concentric tubing. An inline mixer may be coupled to a distal portion of the concentric tubing such that a first fluid passing through the first channel and a second fluid passing through the second channel are both input into one end of the inline mixer for mixing. Optionally, the inline mixer may be connected to a distal end of the coiled tubing. The well may include a wellbore formed to reach a subterranean formation containing valuable hydrocarbons, such as oil and/or gas. However, depending upon the presence of various zones producing oil, gas, water and combinations of these fluids, it can be important to isolate one or more zones containing an undesired fluid from one or more other zones containing a desired fluid. For example, a first zone that contains mostly water or brine may be isolated from a second zone that contains a high concentration of oil, so that the oil can be produced from the well while minimizing the amount of water or brine that must also be produced and processed. Embodiments of the pumps and tubing described herein provide the technical benefit of enabling a two-part reactive composition to be introduced at a desired location within a well to form a plug isolating one zone from another zone with greater control over the delivery of the proper ratio of reactants into the desired location of the well while also reducing or eliminating the need for equipment cleanup and/or the potential for equipment damage due to solidification in mixing containers, pumps, tubing and the like.

Some embodiments provide a method of forming a mixed fluid stream. The method comprises supplying a first fluid to a first subset of piston chambers in a pump having multiple piston chambers, supplying a second fluid to a second subset of piston chambers in the pump having multiple piston chambers, operating the pump to discharge the first fluid through the first subset of piston chambers and discharge the second fluid through the second subset of piston chambers, and combining the first fluid discharged from the first subset of piston chambers with the second fluid discharged from the second subset of piston chambers to form the mixed fluid stream. In one option, the first fluid is discharged from the first subset of piston chambers into a discharge conduit or manifold, the second fluid is discharged from the second subset of piston chambers into the discharge conduit or manifold, and the first and second fluids are combined within the discharge conduit or manifold. In another option, the first fluid is discharged from the first subset of piston chambers into a first discharge conduit or manifold, the second fluid is discharged from the second subset of piston chambers into a second discharge conduit or manifold, and the first and second discharge conduits or manifolds are connected at a point some distance downstream to cause mixing of the first and second fluids. According to the latter option, the first and second fluids may be pumped through separate conduits over any desired distance before combining the first and second fluids. Optionally, separate first and second discharge conduits may be connected to an inline mixer that mixes the first and second fluids before releasing the mixed fluids in a desired location, such as a location within a well between two formations or zones in order to form a plug that isolates the two formations or zones. It is a technical benefit of some embodiments that no single piston chamber of the pump will contain both the first and second fluids.

In some embodiments, the first subset of piston chambers includes a first number of piston chambers, the second subset of piston chambers includes a second number of piston chambers, and a ratio of the first number of piston chambers and the second number of piston chambers affects the relative amounts of the first fluid and the second fluid in the mixed fluid stream. In some instances, a ratio of a first number of piston chambers in the first subset to a second number of piston chambers in the second subset may establish a volumetric ratio of the first fluid and the second fluid in the mixed fluid stream. For example, the ratio of the first number of piston chambers in the first subset to the second number of piston chambers in the second subset may be, without limitation, selected from 1:1, 2:1, 3:1, 4:1, 3:2. Other configurations for pumping two or more fluids may be built to combine fluid in other ratios as described according to the specific examples herein and/or the principles disclosed herein.

In some embodiments, the first fluid includes a first reactant, and the second fluid includes a second reactant that is reactive with the first reactant. For example, the first and second reactants may be the components of a two-part epoxy formulation, such as where the first reactant is an epoxy resin and the second reactant is a hardener. Non-limiting examples of the hardener may include an amine, imidazole, and/or anhydride.

Figure 1B:
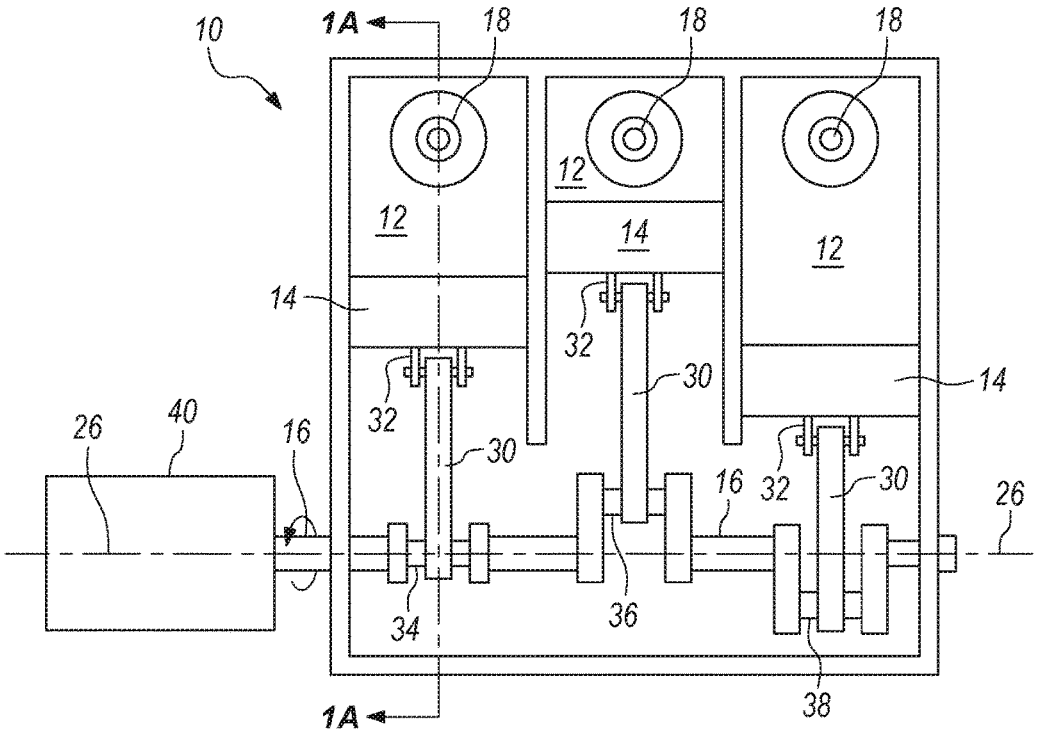
FIG. 1B (PRIOR ART)
Figure 1C:
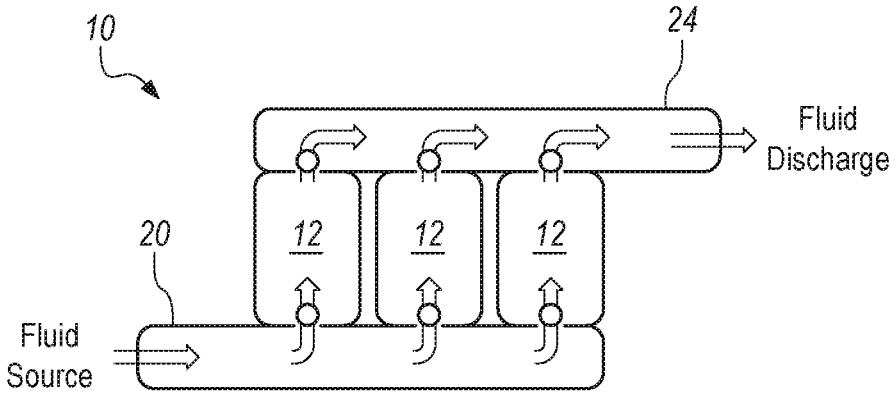
FIG. 1C (PRIOR ART)
FIG. 1C is a schematic diagram of a prior art triplex piston pump having three piston chambers and three corresponding pistons for moving fluid from a common input manifold to a common output manifold.
Figure 2:
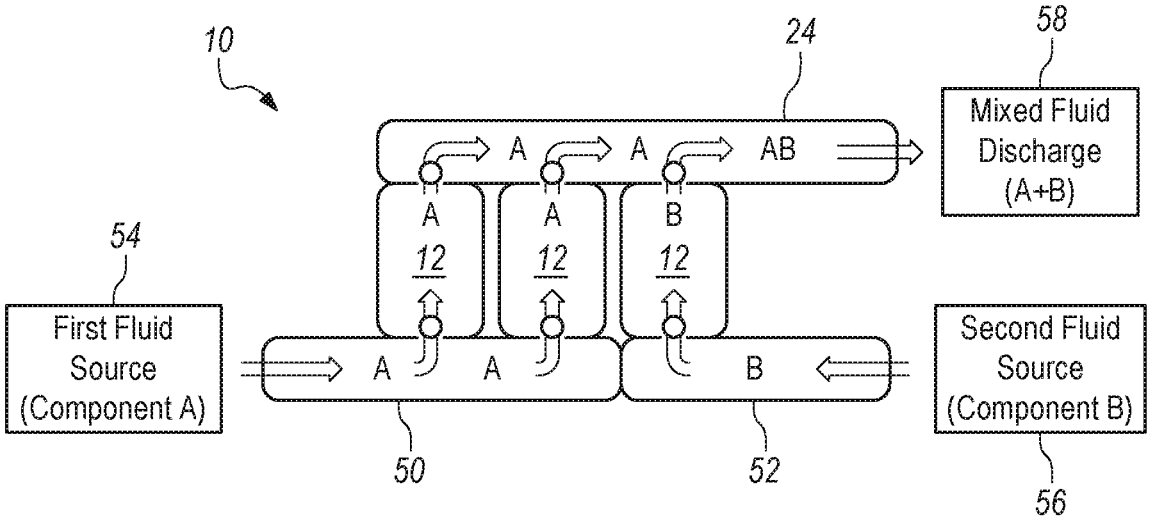
FIG. 2 is a schematic diagram of a triplex piston pump having three piston chambers and three corresponding pistons, wherein two of the piston chambers have their input valve directed to a first fluid input conduit or manifold, one of the piston chambers has its input valve directed to a second fluid input conduit, and all three piston chambers have their output valve directed to a common output conduit or manifold.

FIG. 2 is a schematic flow diagram of the triplex piston pump 10 having three piston chambers 12, wherein two of the piston chambers have their input valve directed to a first fluid input manifold 50 (i.e., a conduit having multiple inputs and/or multiple outlets), one of the piston chambers has its input valve directed to a second fluid input conduit 52, and all three piston chambers 12 have their output valve directed to a common output manifold 24. Although the corresponding three pistons are not shown, they would be located in each of the piston chambers for reciprocation back and forth with respect to the unidirectional valves consistent with FIGS. 1A-B. For example, each piston chamber 12 may have a piston that would move back and away from the illustrated plane in order to draw fluid into the piston chamber through the input valve from the first fluid input manifold 50 or the second fluid input conduit 52 and would then move forward and toward the illustrated plane in order to push the fluid out of the piston chamber 12 through the output valve into the output manifold 24. Accordingly, the input and output valves may be considered to be located at one end (a fluid end) of the piston chamber 12, such as above the top dead center position of the piston. Note that a first fluid source 54 ("Component A") and a second fluid source 56 ("Component B") are input to separate subsets of piston chambers 12 but become mixed in the single (common) output manifold 24. Note that since the first fluid input manifold 50 supplies the first fluid ("Component A") to two piston chambers 12 and the second fluid input conduit 52 supplies the second fluid ("Component B") to one piston chamber 12, the mixed fluid discharge 58 may include an amount of the first fluid ("Component A") that is substantially twice the amount of the second fluid ("Component B") included in the mixed fluid 58 ((i.e., an A:B ratio of about 2:1).

Figure 3:
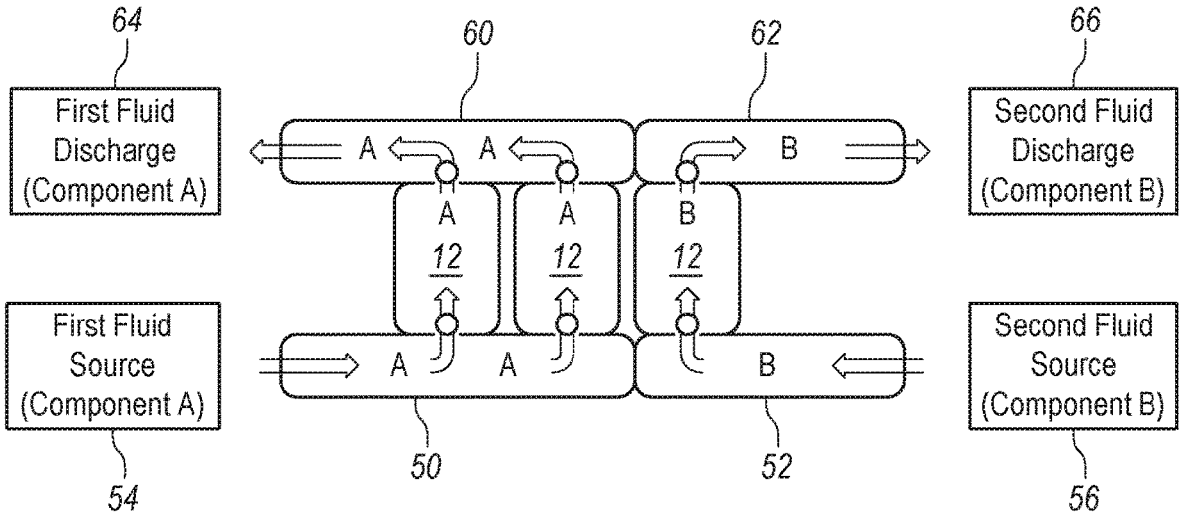
FIG. 3 is a schematic diagram of a triplex piston pump having three piston chambers and three corresponding pistons, wherein two of the piston chambers have their input valve directed to a first fluid input conduit or manifold and their output valve directed to a first output conduit or manifold, and wherein one of the piston chambers has its input valve directed to a second fluid input conduit and its output valve direct to a second fluid output conduit.

FIG. 3 is a schematic flow diagram of the triplex piston pump 10 having three piston chambers 12 as in FIG. 2. Furthermore, two of the piston chambers 12 have their input valve directed to the first fluid input manifold 50 (i.e., a conduit having multiple inputs and/or multiple outlets) that receives fluid from the first fluid source 54 ("Component A") and one of the piston chambers has its input valve directed to the second fluid input conduit 52 that receives fluid supplied from the second fluid source 56 ("Component B").

However, unlike the configuration in FIG. 2, the piston pump 10 has a first fluid output conduit (manifold) 60 and a separate second fluid output conduit 62. Accordingly, the first and second fluids do not become mixed in a single fluid output conduit (manifold) but are kept as separate fluid streams. The first fluid discharge 64 ("Component A") receiving the output of the first fluid output conduit 60 and the second fluid discharge 66 ("Component B") receiving the output of the second fluid output conduit 62. Note that since the first fluid output conduit 60 receives the first fluid ("Component A") from two piston chambers 12 and the second fluid output conduit 62 receives the second fluid ("Component B") from one piston chamber 12, the relative amount of the first fluid ("Component A") moved through the piston pump 10 is substantially twice the amount of the second fluid ("Component B") that is moved through the piston pump 10 (i.e., an A:B ratio of about 2:1). The two fluids (Components A and B) are supplied to the pump by separate input conduits or manifolds, input to separate subsets of piston chambers, and are output to separate output conduit such that the two fluids are kept separate. However, the first and second fluid discharges 64, 66 may be coupled to pipes, tubes or channels that extend to a target location for mixing, such as by directing the two fluids through a static mixer.

Figure 4:
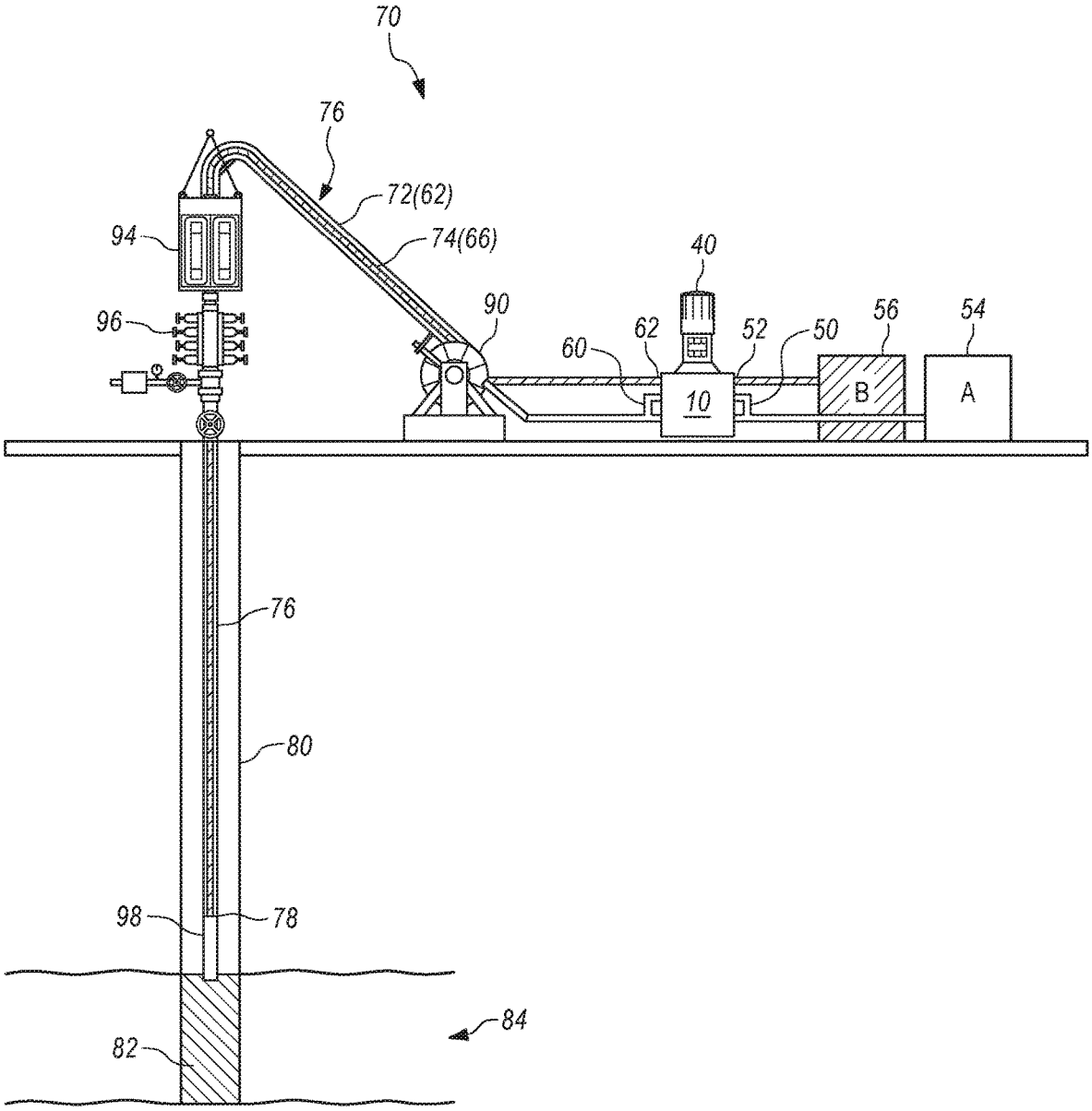
FIG. 4 is a schematic diagram of a system in which the first and second output conduits from the triplex piston pump are coupled to separate concentric channels in a coiled tubing that is controllably positioned in a desired location within a well.

FIG. 4 is a schematic diagram of a system 70 in which the first and second output conduits 60, 62 from the triplex piston pump 10 are coupled to separate concentric channels 72, 74 in coiled tubing 76 that is controllably positioned to have a distal end 78 in a desired location within a well 80. For example, the first fluid ("Component A"). Embodiments may also include other bi-channel tubing configurations or the use of two separate tubes. In some embodiments, the objective of the operation may be to form a solid plug 82 within a target region 84 of the well 80, such as to isolate an upper formation from a lower formation. For example, the solid plug 82 may be an epoxy plug formed by delivering a first and second reactive components to the target region 84 of the well 80 where they can react and form the solid plug 82.

A first storage tank 54 may store a first liquid composition (A) containing a first reactive component and a second storage tank 56 may store a second liquid composition (B) containing a second reactive component. Optionally, the first and second liquid compositions may include any number of components, whether reactive or non-reactive, but the components within the first liquid composition should not undergo a reaction independent of the second liquid composition, and the components within the second liquid composition should not undergo a reaction independent of the first liquid composition. As a result, both first and second liquid compositions are stable until mixed together.

The triplex piston pump 10 has a first inlet conduit 50 in fluid communication with the first storage tank 54 ("Component A"), a second inlet conduit 52 in fluid communication with the second storage tank 56 ("Component B"), a first output conduit 60 in fluid communication with the first input conduit 50 ("Component A") and the annular channel 72 of the bifurcated tubing 76, and a second output conduit 62 in fluid communication with the second input conduit 52 ("Component B") and the central channel 74 of the bifurcated tubing 76. Operation of the motor 40 causes the piston pump 10 to draw the first fluid ("Component A") from the first storage tank 54 and deliver the first fluid into the annular channel 72 of the bifurcated tubing 76 while simultaneously drawing the second fluid from the second storage tank 56 and delivering the second fluid into the central channel 74 of the bifurcated tubing 76. A tubing reel 90 may be provided and may include fluidic connections between the outlet conduits 60, 62 to the first and second channels 72, 74 of the tubing 76.

In the illustrated embodiment, a coiled tubing injector 94 is suspended above the wellhead 96 to allow the coiled tubing 76 to be raised and lowered in the well 80. The tubing 76 may be inserted into the well 80 until the distal end 78 supporting an inline mixer 98 reaches the target region 84. With the distal end of the tubing in a desired position, the piston pump 10 is operated to deliver the first and second fluids, in the predetermined ratio, into the first and second channels of the bifurcated tubing 76, through the static mixer 98, and into the wellbore below or around the static mixer 98. The first and second reactive components of the first and second fluids 54, 56, respectively, begin to react upon mixing in the static mixer 98 and will continue to react in the wellbore to form the solid plug 82.

After a sufficient total volume of the mixture has been delivered into the wellbore 80 to form the solid plug 82, the tubing 76 may be withdrawn from the well 80. Optionally, any of the first and/or second liquid compositions that were not used or contaminated may be flushed back into the appropriate storage tank to be used later. Only the mixing device 98 should have any of the reaction products, such as catalyzed or hardened polymer, that may require cleanup, greatly reducing handling and cleanup costs.

Non-Limiting Example:

An epoxy resin is developed to be pumped into an oil and gas well to produce a gas impermeable plug. The epoxy resin may be formed by the reaction of reactants of two separate fluid compositions (A and B) that must be mixed at a 2:1 ratio, such as two (2) parts A to one (1) part B. For this example, assume that the flow rate at which the epoxy must be pumped and the pressures which are needed to overcome friction and hydrostatic pressure require that the epoxy must be pumped at 5,000 psi.

Current practice in the oil and gas industry would be to pour the required total volume of fluid composition A and fluid composition B of the epoxy into a large mixing vessel. As the reactants in compositions A and B catalyze, an exothermic reaction would occur, and the heat produced would accelerate the reaction. Chemical retarders would therefore be added to the mix to prevent "flash curing". Once mixed, the fully mixed and reacting epoxy composition would then be pumped with a low-pressure transfer pump to a high-pressure piston pump and displaced into the well. The mixer, low pressure transfer pump, high-pressure pump and the tubing would then have to be flushed to remove the catalyzing epoxy.

A triplex pump may be configured to pump the same epoxy formulation and perform the mixing at a 2:1 ratio of compositions A and B, respectively. Specifically, composition A may be supplied via a first input conduit to two of the piston chambers and composition B may be supplied via a second input conduit to the remaining one piston chamber to achieve the required 2:1 ratio of compositions A and B in a single output conduit or manifold. The triplex pump is capable of producing the required pressures, rates and volumes. With a triplex pump configured in the manner described, an operator may simply run the triplex pump until the desired amount of epoxy resin has been pumped into the well. Optionally, displacement water may then be fed through all piston chambers of the triplex pump as a means of displacing the catalyzing epoxy resin from the tubing into the well and cleaning the pump and associated flow paths of all catalyzing epoxy, thus eliminating any cleanup, reducing environmental impact.

The two compositions A and B of the epoxy formulation may be discharged from the pump chambers under pressure and may be placed into significant turbulent flow. The turbulent flow conditions cause the two components to become thoroughly mixed. If further blending of the epoxy formulation is needed, then the output manifold from the triplex pump can be fitted with a mixing apparatus, such as a static mixer.

Some embodiments provide an apparatus comprising a fluid end block. A first set of multiple linear bores are directed through the fluid end block in a primary direction, wherein each of the linear bores in the first set form a piston chamber. A second set of multiple linear bores are directed through the fluid end block in a lateral direction, wherein each of the linear bores in the second set form a cross bore that intersects with one of the piston chambers, and wherein each cross bore has a fluid inlet end and a fluid outlet end. In addition, one or more outlet bores are directed into the fluid end block in a longitudinal direction, wherein the fluid outlet end of each cross bore is intersected by one of the outlet bores. A first inlet bore is directed into the fluid end block in the longitudinal direction from a first end of the fluid end block, wherein the first inlet bore is a first blind bore that intersects with the fluid inlet end of a first subset of the cross bores. A second inlet bore is directed into the fluid end block in the longitudinal direction from a second end of the fluid end block that is opposite the first end of the fluid end block, wherein the second inlet bore is a second blind bore that intersects with the fluid inlet end of a second subset of the cross bores, and wherein a portion of the fluid end block separates a bottom end of the first blind bore and a bottom end of the second blind bore. Still further, the apparatus comprises a plurality of inlet valve assemblies including, for each piston chamber, one of the inlet valve assemblies secured within the fluid inlet end of the cross bore that intersects with the piston chamber to allow one-way fluid flow into the piston chamber, and a plurality of outlet valve assemblies including, for each piston chamber, one of the outlet valve assemblies secured within the fluid outlet end of the cross bore that intersects with the piston chamber to allow one-way fluid flow out of the piston chamber.

The fluid end block may be made from a range of metals and metal alloys selected for their strength, fatigue resistance, and corrosion performance in the fluids that will pass through the fluid end block. Carbon steels and low-alloy steels are frequently used for general industrial duties due to their good machinability and toughness, while stainless steels (such as austenitic and martensitic grades) are chosen when resistance to corrosion, pitting, or erosion is required. For more aggressive environments, nickel-based alloys and duplex or super-duplex stainless steels provide enhanced resistance to chloride stress corrosion cracking and high mechanical strength.

The linear bores are formed in the fluid end block along a linear axis. Each linear bore may have its own axis, although the first and second inlet bores may be axially aligned. Similarly, if the one or more outlet bores include first and second outlet bores, then the first and second outlet bores may be axially aligned. The linear bores may be formed by machining or boring to remove material from the fluid end block and leave the linear bore (i.e., linear passage or channel) within the fluid end block, although one or more of the linear bores could be formed during casting or additive manufacturing of the fluid end block. Optionally, the fluid end block may be a monolithic piece of metal, where the first set of multiple linear bores, the second set of multiple linear bores, the outlet bore, the first inlet bore and/or the second inlet bore have been machined from the fluid end block.

In some embodiments, each of the linear bores in the first set are parallel, each of the linear bores in the second set are parallel, and/or the first and second inlet bores are parallel to the outlet bore. Where the linear bores are machined into the fluid end block, this is particularly facilitated by having a rectangular cuboid fluid end block, although the shape of the fluid end block may be many different shapes. Furthermore, the primary direction may be perpendicular to the lateral direction, and the longitudinal direction may be perpendicular to both the primary direction and the lateral direction. The perpendicularity between the primary, lateral and longitudinal directions is preferable to simplify manufacturing and make efficient use of the fluid end block, but this perpendicularity is not strictly required.

In some embodiments, each of the linear bores in the first set may be through-holes. A "through-hole" is a hole formed completely through a workpiece such as the fluid end block. For example, where the through-hole is formed by drilling or machining, the drill bit will enter one face of the workpiece and extend through the workpiece until it exits the opposite face of the workpiece. By contrast, a "blind hole" or "blind bore" is a hole that is formed in a workpiece to a controlled depth that is less than the thickness of the workpiece where the hole is formed. For example, where the blind-hole is formed by drilling or machining, the drill bit will enter one face of the workpiece, extend into the workpiece to the selected depth and then stop short before breaking through the opposite face workpiece. The distal end of the blind hole may be referred to as the "bottom" of the hole regardless of the orientation of the blind hole. The bottom of the hole or bore may be conical, flat or other desired shapes facilitated by a corresponding shape of a tip of the drill bit or machine tool.

In some embodiments, one or more ends of a through-hole or the open end of a blind hole may be closed off by extending a cover plate over open end of the hole and securing the cover plate to the fluid end block. Optionally, a gasket may be disposed between the cover plate and the fluid end block to assist with forming a fluid-tight seal. For example, the purpose of the cross bores is to establish a fluid passage from an inlet bore to the piston chamber and establish a fluid passage from the piston chamber to an outlet bore. Accordingly, if the cross bores are formed by a through-hole, then both ends of the cross bores may be closed off with a cover plate. For example, where the each of the linear bores in the second set (forming the cross bores) are through-holes, the apparatus may further comprise a first cover plate secured to the fluid end block to close off a first end of the through-holes and a second cover plate secured to the fluid end block to close off a second end of the through-holes. By contrast, if each of the linear bores in the second set (forming the cross bores) are blind bores having only one open end, then the apparatus may comprise a first cover plate secured to the fluid end block to close off the open ends of the blind bores in the second set. The bottom ends of these blind bores are already closed off by the nature of being a blind bore and do not require a cover plate to close off the bottom end of the blink bore.

In some embodiments, the first inlet bore is axially aligned with the second inlet bore. However, since both the first and second inlet bores are blind bores entering the fluid end block from opposite sides or faces of the fluid end block, each blind bore stops short of the other blind bore such that a portion of the fluid end block separates a bottom end of the first blind bore and a bottom end of the second blind bore.

The number of linear bores in the first set may form any number of piston chambers. However, the first set of multiple linear bores preferably form 2 to 5 piston chambers. This number of piston chambers is most practical in operation while still supporting the formation of fluid ends that will, in combination with the power end, provide a volumetric ratio of a first fluid via the first inlet bore and a second fluid via the second inlet bore that is selected from 1:1, 2:1, 3:1, 3:2 and 4:1. It should also be recognized that the number of cross bores formed by the second set of multiple linear bores is equal to the number of piston chambers formed by the first set of multiple linear bores. In other words, each piston chamber needs a corresponding cross bore to deliver fluid from an inlet bore to the piston chamber and deliver fluid from the piston chamber to an outlet bore.

In some embodiments, the one or more outlet bores that are directed into the fluid end block in the longitudinal direction is a single outlet bore intersecting with the fluid outlet end of each of the cross bores. A single outlet bore will be in communication with the fluid outlet end of all of the cross bores and receive fluids from both the first inlet bore and the second inlet bore. Where the first inlet bore is supplied with a first fluid and the second inlet bore is supplied with a second fluid, the first and second fluids will become mixed in the single outlet bore.

In some embodiments having a single outlet bore, the single outlet bore may be a blind hole having only one open end through which fluid may exit the fluid end during operation. The blind hole or bore should still intersect with the fluid outlet end of each cross bore, but the blind hole should form a bottom end rather than piercing through the enter workpiece (the fluid end block).

In some embodiments that have a single outlet bore, the single outlet bore may be a through-hole having a first open end and an opposing second open end. In one option, a cover plate may be secured to the fluid end block to close off one end of the through-hole and direct all of the fluid to exit the fluid end through the opposite end of the through-hole. In another option, the first and second open ends may both be kept open to allow fluid to exit through both open ends.

In some embodiments, the one or more outlet bores directed into the fluid end block in a longitudinal direction include a first outlet bore that intersects with the fluid outlet ends of a first subset of the cross bores and a second outlet bore that intersects with the fluid outlet ends of a second subset of the cross bores. Accordingly, the first outlet bore may be a blind bore that extends into the fluid end block from a first end and the second outlet bore may be a blind bore that extends into the fluid end block from a second end opposite the first end. Furthermore, the first outlet bore may be axially aligned with the second outlet bore. However, since both the first and second outlet bores are blind bores entering the fluid end block from opposite sides or faces of the fluid end block, each blind bore stops short of the other blind bore such that a portion of the fluid end block separates a bottom end of the first blind bore and a bottom end of the second blind bore. In one option, the first subset of cross bores that intersect with the first outlet bore and the first subset of cross bores that intersect the first inlet bore are the same cross bores, and wherein the second subset of cross bores that intersect with the second outlet bore and the second subset of cross bores that intersect the second inlet bore are the same cross bores. In this configuration, a first fluid that enters the first inlet bore will exit the first outlet bore, and a second fluid that enter the second inlet bore will exit the second outlet bore. According to this latter option, the first and second fluids are pumped through the same fluid end but are kept separate the entire time. However, the embodiments of the fluid end disclosed herein provide the technical advantage that two fluids may be pumped in a precise volumetric ratio without involving two pumps and a complicated fluid measurement and control system. Rather, the ratio of the number piston chambers pumping each fluid mechanically determines the volumetric ratio since each piston and piston chamber within a given fluid end has the same stroke volume. However, embodiments of the fluid end may be configured with piston chambers having any of a wide range of diameters and stroke lengths as selected for a given fluid service or application. For example, a smaller diameter piston chamber may provide a higher pressure and lower flow rate than a larger diameter piston chamber. If the volumetric ratio is particularly critical in some implementations, then care should be taken to provide the first and second fluid at similar viscosities, inlet pressures and outlet pressures.

In some embodiments, the apparatus may further comprise a plurality of pipe neck flanges. Each pipe neck flange includes a pipe segment having a first end secured to the fluid end block in fluid communication with an inlet or outlet bore and a second end secured to a flange. The plurality of pipe neck flanges may include a first pipe neck flange forming a connection to the first inlet bore, a second pipe neck flange forming a connection to the second inlet bore, and one or more pipe neck flange forming a connection to the one or more outlet bores. Where the fluid end is intended to have only a single outlet bore with a single fluid outlet (i.e., a single pipe neck flange), the single fluid outlet may be on either end of the fluid end block. The pipe neck flanges are typically welded to the fluid end block for use in high pressure configurations. However, for low pressure configurations, threaded pipe connections, such as female national pipe thread ports, may be used in place of the welded pipe neck flanges.

In some embodiments, the apparatus may further comprise pistons and a power end assembly connected to the fluid end block to form a working pump. The power end of a pump is the mechanical, dry-side assembly that converts rotational power from a driver, such as a motor or engine, into reciprocating linear motion to drive the fluid end. In one example, the power end may include a frame, crankshaft, connecting rods, and crossheads. The pistons are received within the piston chambers (cylinders) of the fluid end block and are considered part of the fluid end (also referred to as the hydraulic end) because they operate directly on the fluid that enters the piston chambers. The power end assembly includes a crank shaft coupled to a plurality of pistons by the connecting rods and crossheads, wherein each of the pistons is configured to reciprocate within one of the piston chambers to provide an equal stroke volume in response to forced rotation of the crankshaft by the driver. The frame or crankcase is securely connected to the fluid end block and houses, aligns and supports the crankshaft throughout its rotation. For example, the frame or crankcase may be securely connected using a set of bolts, perhaps with an elastomer or high pressure metal gasket there between.

In some embodiments, each of the linear bores in the second set forming the cross bores are through-holes. While the cross bores establish a fluid passage from an inlet bore to a piston chamber and from the piston chamber to an outlet bore, the two opposing open ends of a cross bore that is formed as a through-hole must be closed off. In one option, these open ends are closed off using a cover plate secured to the fluid end block. For example, a single cover plate may cover the fluid outlet ends of all cross bores in the fluid end block. A plurality of threaded bolts and a gasket may be used for this purpose. In another option, the open ends of the cross bores may be closed off using inlet valve assemblies and outlet valve assemblies that serve the dual purpose of securely positioning a corresponding inlet or outlet valve within the cross bore and closing off the open end of the cross bore. Each cross bore that is formed by a through-hole will receive one inlet valve assembly and one outlet valve assembly. Without limitation, each of the inlet valve assemblies may include a ported sleeve having a first end, a second end and a middle portion between the first and second ends, wherein the first end is connected to a blind flange secured to an outer surface of the fluid end block to close off the fluid inlet end of one of the cross bores, the second end secures an inlet valve in position within the fluid inlet end of the cross bore, and the middle portion is open and forms a passage from the inlet valve to the first or second fluid inlet bore. Without limitation, each of the outlet valve assemblies may include a ported sleeve having a first end, a second end and a middle portion between the first and second ends, wherein the first end is connected to a blind flange secured to an outer surface of the fluid end block to close off the fluid outlet end of one of the cross bores, the second end secures an outlet valve in position within the fluid outlet end of the cross bore, and the middle portion is open and forms a passage from the outlet valve to one of the one or more fluid outlet bores. The passages in each of the ported sleeves is preferably open on two sides to support fluid flow along the entire length of a given inlet or outlet bore. The inlet and outlet valve assemblies may be substantially the same, except for the orientation of the valve. Specifically, the inlet valve should be oriented to allow fluid flow from the inlet bore and the fluid inlet end of the cross bore to flow into the piston chamber during a suction stroke of the piston and to prevent fluid flow from the piston chamber into the fluid inlet end of the cross bore and the inlet bore during a discharge stroke of the piston. By contrast, the outlet valve should be oriented to allow fluid flow from the piston chamber into the fluid outlet end of the cross bore and the outlet bore during a discharge stroke of the piston and to prevent fluid flow from the fluid outlet end of the cross bore and the outlet bore to flow into the piston chamber during a suction stroke of the piston. It should be appreciated that the foregoing valve assemblies based on ported sleeves are non-limiting embodiments and that inlet and outlet valves may be secured within the cross bores using other mechanical structures and configurations. For example, a valve seat (sealing surface) may be threaded into the cross bore and a valve (disc, plug, ball, or other flow controller) may be attached to or captured by the valve seat. The inlet and outlet valves may be considered to be check valves that are self-actuating, one-way valves that allow fluid to flow in one direction while preventing back flow in the other direction.

In some embodiments, the cover plates or valve assemblies that close off one of the bores may be easily removed to support maintenance of the components of the fluid end. For example, the cover plates that are bolted to the fluid end block to close off the linear bores in the first set of linear bores, which linear bores form the piston chambers, may be easily removed to enable quick and easy extraction of the pistons so the packings can be replaced or serviced. The cover plates or flanges of a ported sleeve that are bolted to the fluid end block to close off the second set of linear bores, which linear bores form the cross bores, may be easily removed to enable quick and easy extraction of the valve assemblies for servicing or replacement.

Figure 5:
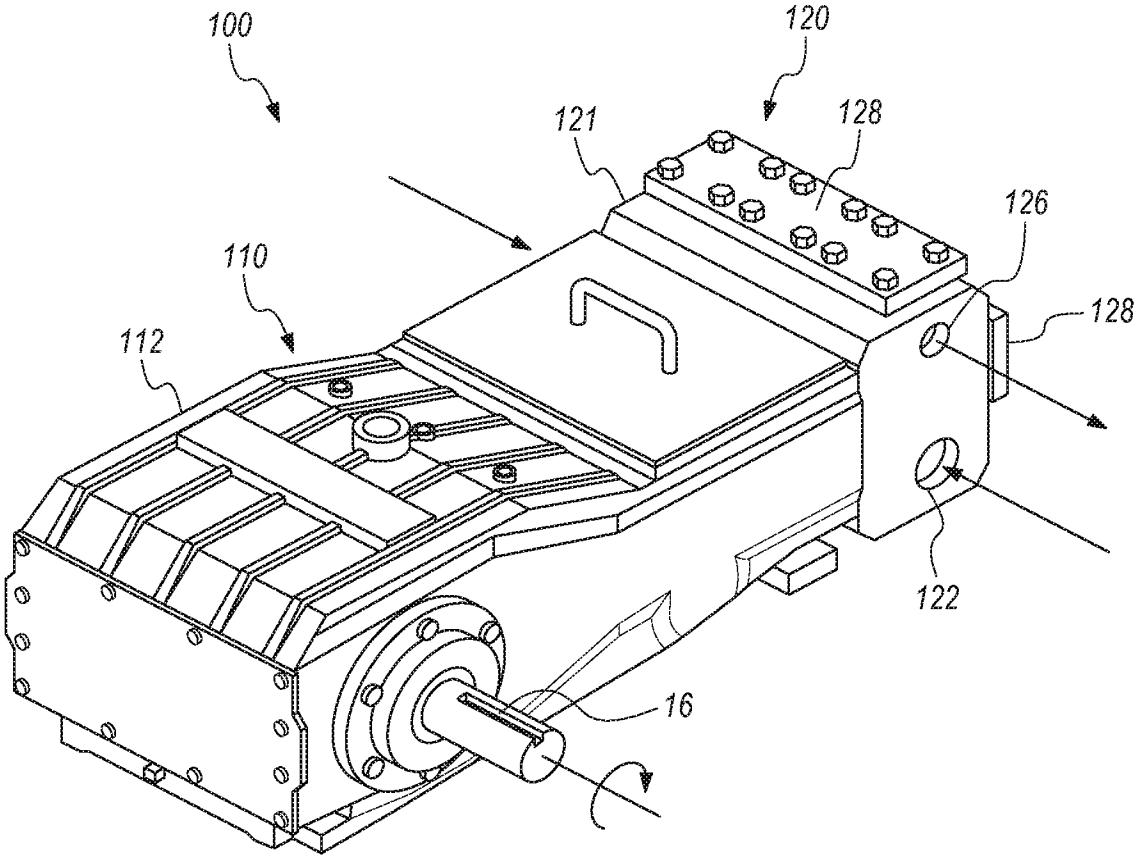
FIG. 5 is a perspective view of a pump having a fluid end connected to a power end according to one embodiment.

FIG. 5 is a perspective view of a multiplex pump 100 having a fluid end 120 connected to a power end 110 according to one embodiment. The fluid end 120 includes a fluid end block 121 with several cover plates 128, a first inlet bore or manifold 122 and a second inlet bore or manifold (not shown; but see second inlet bore 124 in FIG. 6) to an outlet bore or manifold 126.

The multiplex pump 100 includes multiple plungers or pistons (not shown; but see pistons 14 in FIGS. 1A-B). A driver, such as an engine or motor (not shown; but see motor 40 in FIG. 1B) is used to rotate the crankshaft 16 relative to a frame 112 and cause the pistons to pump fluid from the first inlet bore or manifold 122 and the second inlet bore or manifold (not shown; but see second inlet bore 124 in FIG. 6) to the outlet bore or manifold 126 of the piston chamber 12 in which the individual piston 14 operates.

With further reference to FIGS. 1A-B as well as FIG. 5, mechanical power is applied to the crankshaft 16. As the crankshaft 16 rotates about the axis 26, pistons 14 attached to the crankshaft 16 by rods 30 reciprocate. In the fluid end 120, each piston chamber 12 has a set of valve seats. When the piston 14 is withdrawn, a suction pressure is formed within the piston chamber that causes the inlet valve 18 to open and permit fluid to flow into the piston chamber 12, while simultaneously closing the outlet valve 22. When the piston 14 is pushed into the piston chamber 12, a discharge pressure is formed within the piston chamber that causes the outlet valve 22 to open and permit fluid to flow from the piston chamber 12 into the outlet, while simultaneously closing the inlet valve 22. Each time the crankshaft completes a full rotation, each of the three pistons intake fluid from the inlet or intake and discharges fluid it into the outlet.

Figure 6:
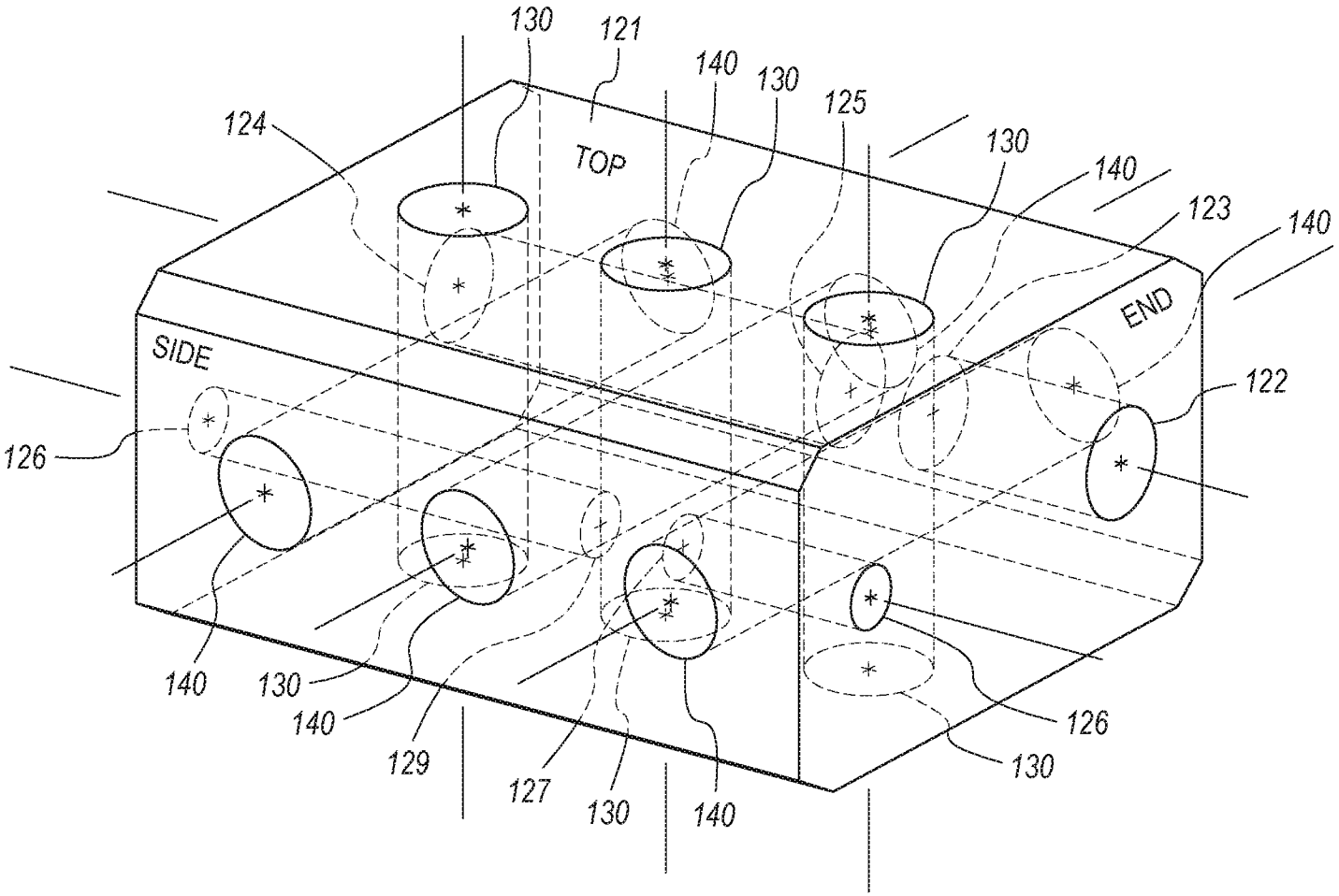
FIG. 6 is a perspective view of a fluid end block having a first set of linear bores forming piston chambers, a second set of linear bores forming cross bores, first and second inlet bores, and one or more outlet bores according to one embodiment.

FIG. 6 is a perspective view of the fluid end block 121 having a first set of linear bores forming piston chambers 130, a second set of linear bores forming cross bores 140, first and second inlet bores 122, 124, and one or more outlet bores 126 according to one embodiment. In a preferred configuration, the inlet bores 122, 124 have a larger diameter than the outlet bore(s) 126 because the fluid supply to the pump is usually provided at a low pressure, such as a gravity fluid feed. The larger diameter bore provides less restriction to fluid flow.

An important aspect of the embodiments is that the first inlet bore 122 does not have any internal connections to the second inlet bore 124. In fact, the first inlet bore 122 is a blind bore that enters the fluid end block 121 from a first end (on the right in FIG. 6), intersects with one of the cross bores 140, and forms a bottom 123. Similarly, the second inlet bore 124 is a blind bore that enters the fluid end block 121 from a second end (on the left in FIG. 6), intersects with two of the cross bores 140, and forms a bottom 125. The "gap" between the two bottoms 123, 125 is part of the fluid end block 121 such that the first and second inlet bores 122, 124 are completely isolated.

In some embodiments, outlet bore 126 is a single linear bore. However, in other embodiments, the outlet bore 126 may be formed by two blind bores in a manner similar to the inlet bores 122, 124. As shown, a first outlet bore 126 is a blind bore that enters the fluid end block 121 from a first end (on the right in FIG. 6), intersects with one of the cross bores 140, and forms a bottom 127. Similarly, a second outlet bore 126 is a blind bore that enters the fluid end block 121 from a second end (on the left in FIG. 6), intersects with two of the cross bores 140, and forms a bottom 129. The "gap" between the two bottoms 127, 129 is part of the fluid end block 121 such that the first and second outlet bores 126 are completely isolated. However, as previously stated, the outlet bore 126 may be a single linear bore, such as a through-hole or even a blind hole that interests each of the cross bores 140 (i.e., there is no bottom 127, no bottom 129 and no gap).

The fluid end block 121 shown in FIG. 6 is used to form a fluid end for a tri-plex pump (i.e., a reciprocating piston pump having three pistons). The fluid end block 121 has three piston chambers 130, three cross bores 140, two inlet bores 122, 124, and one or two outlet bores 126. However, other embodiments may include greater or fewer piston chambers 130 and corresponding cross bores 140, such as from 2 to 5 piston chambers. For clarity, FIGS. 7A-B show the fluid end block 121 with only the piston chambers 130, FIGS. 8A-B show the fluid end block 121 with only the cross bores 140, and FIGS. 9A-B show the fluid end block 121 with only the inlet and outlet bores.

Figure 7A:
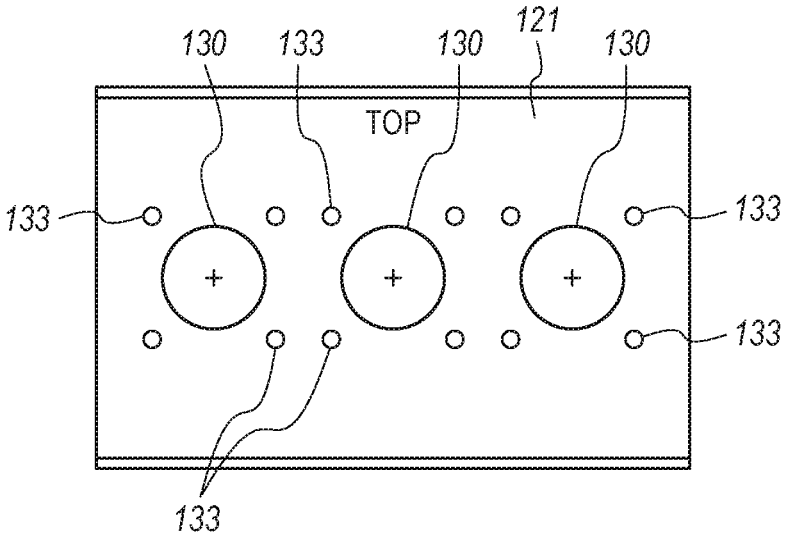
FIG. 7A is a plan view of a top of a fluid end block and FIG. 7B is a perspective view of the fluid end block with a cover plate aligned for securing to the fluid end block to close off the piston chambers according to one embodiment.
Figure 7B:
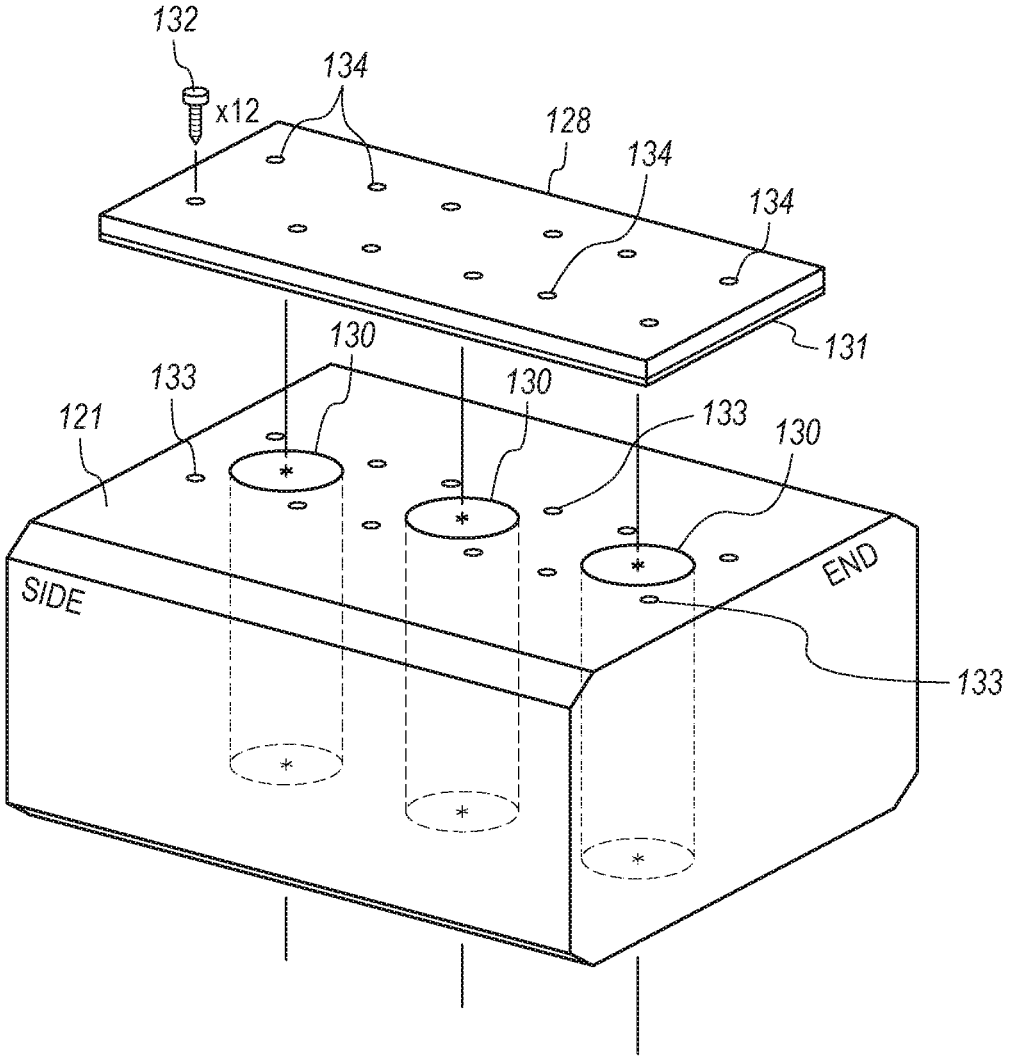

FIG. 7A is a plan view of a top of the fluid end block 121 and FIG. 7B is a perspective view of the fluid end block 121 with a cover plate 128 aligned for securing to the fluid end block 121 to close off the piston chambers 130 according to one embodiment. In FIG. 7A, three linear bores are formed in the fluid end block 121 in a primary direction and spaced apart configuration to form three piston chambers 130. As shown, the piston chambers 130 have are cylindrical shape with a central axis, where each of the piston chambers 130 are parallel to each other. A set of threaded holes 133 (twelve shown) are also formed in the top surface extending into the fluid end block 121 to receive a corresponding set of screws or bolts arranged around the openings of the piston chambers 130.

In the perspective view of FIG. 7B, the piston chambers 130 are shown to extend through the fluid end block 121 with top and bottom open ends. The top ends of the three piston chambers 130 may be closed off by securing the cover plate 128 to the top surface of the fluid end block 121 using a set of screws or bolts 132. Without limitation, the cover plate 128 is illustrated with twelve unthreaded holes 134, the fluid end block 121 is illustrated with twelve threaded holes 133, and twelve screws or bolts 132 will be used to secure the cover plate to the fluid end block 121. An optional gasket 131 may be disposed between the cover plate 128 and the fluid end block 121. The bottom ends of the piston chambers 130 is kept open to received pistons.

Figure 8A:
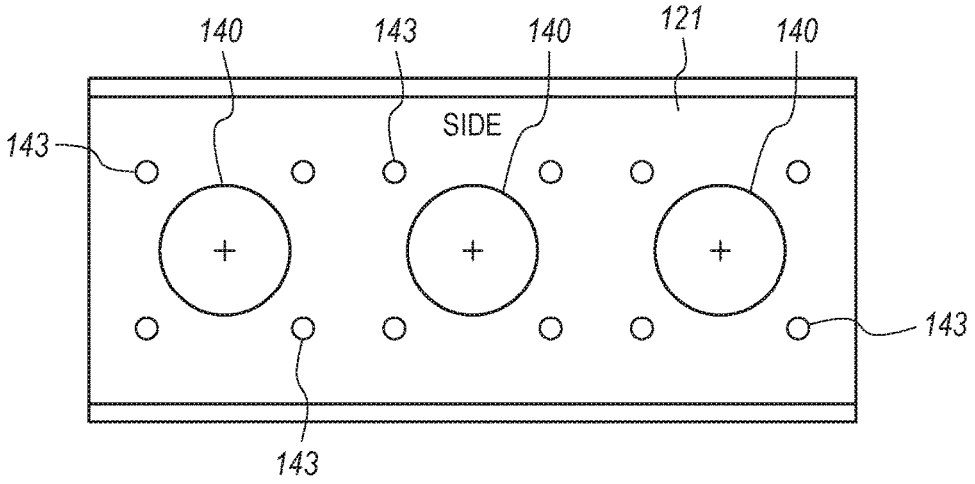
FIG. 8A is a plan view of a side of a fluid end block and FIG. 8B is an end view of the fluid end block with cover plates aligned for securing to the fluid end block to close off both ends of the cross bores according to one embodiment.
Figure 8B:
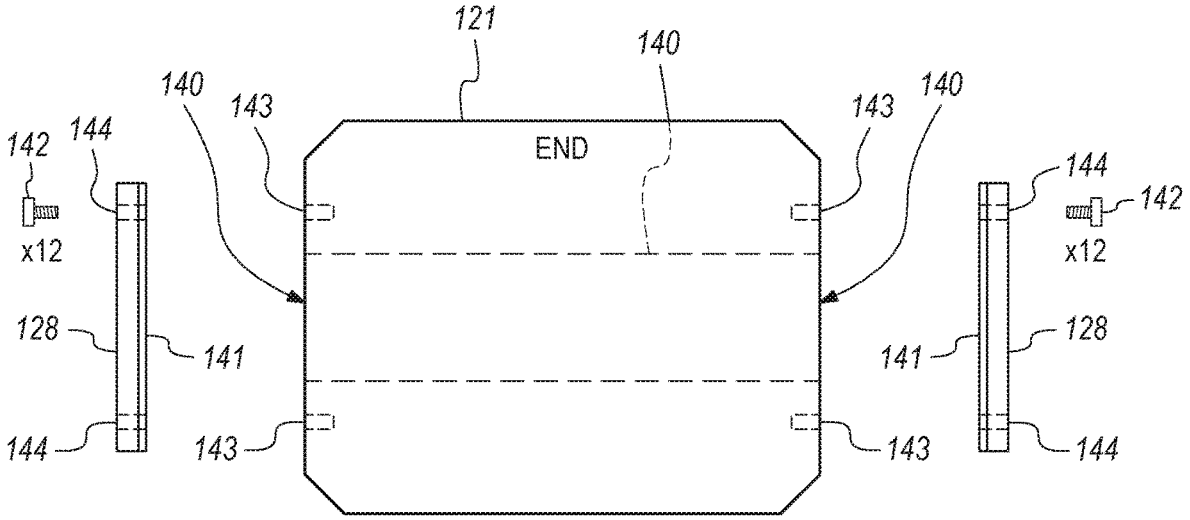
Figure 9A:
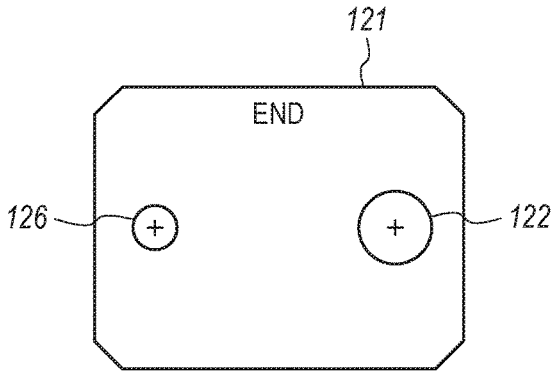
FIG. 9A is an end view of a fluid end block with ports to the inlet and outlet bores and FIG. 9B is a top view of the fluid end block with pipe neck flanges aligned for securing to the fluid end block to provide fluidic connection to both ends of the inlet bore and one or both ends of the outlet bore according to one embodiment.
Figure 9B:
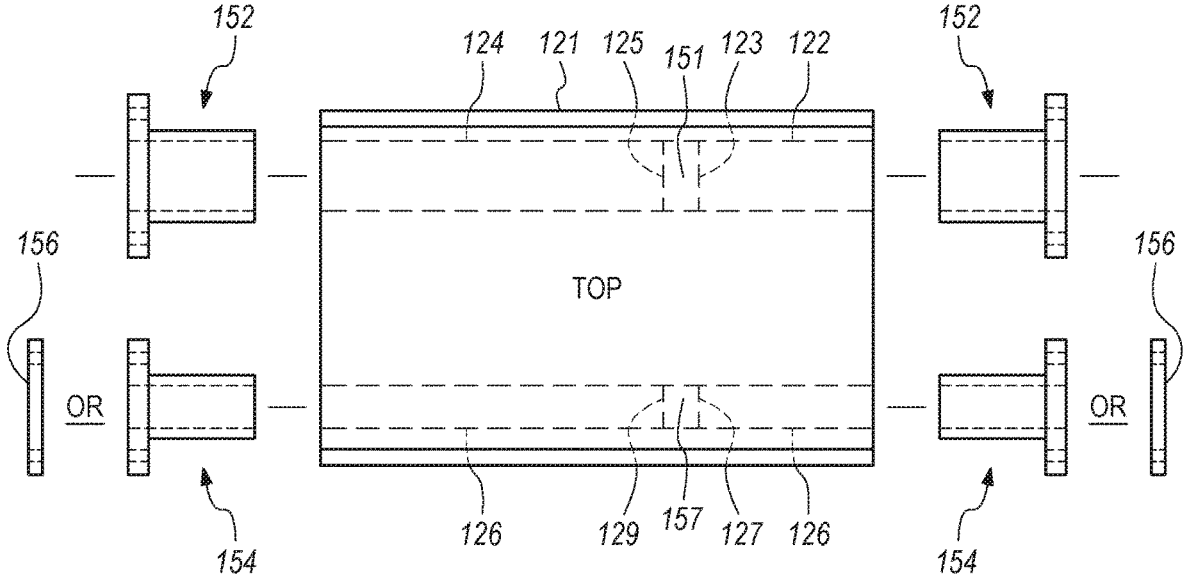

FIG. 8A is a plan view of a side of the fluid end block 121 and FIG. 8B is an end view of the fluid end block 121 with a pair of cover plates 128 aligned for securing to the fluid end block 121 to close off both ends of the cross bores 140 according to one embodiment. In FIG. 8A, three linear bores are formed in the fluid end block 121 in a lateral direction (from side to side; perpendicular to the piston chambers 130 of FIGS. 7A-B) and spaced-apart configuration to form three cross bores 140. As shown, the cross bores 140 have are cylindrical shape with a central axis, where each of the cross bores 140 are parallel to each other. A set of threaded holes 143 (twelve shown) are also formed in the side surface extending into the fluid end block 121 to receive a corresponding set of screws or bolts arranged around the openings of the cross bores 140.

In the end view of FIG. 8B, the cross bores 140 (one behind the other) are shown to extend through the fluid end block 121 with two open ends. The two opposing ends of the three cross bores 140 may be closed off by securing the cover plates 128 to the side surfaces of the fluid end block 121 using a set of screws or bolts 142. Without limitation, each cover plate 128 is illustrated with twelve unthreaded holes 144, the fluid end block 121 is illustrated with twelve threaded holes 143, and twelve screws or bolts 142 will be used to secure the cover plates to the fluid end block 121. A pair of optional gaskets 141 may be disposed between the cover plate 128 and the fluid end block 121.

FIG. 9A is an end view of the fluid end block 121 with ports to the inlet bore 122 and the outlet bore 126 and FIG. 9B is a top view of the fluid end block 121 with pipe neck flanges 152, 154 aligned for securing to the fluid end block 121 to provide fluidic connection to both of the inlet bores 122, 124 and one or both ends of the outlet bore 126 according to some embodiments. The bottom 123 of the first inlet bore 122 and the bottom 125 of the second outlet bore 126 are separated by the gap 151, which comprises a portion of the fluid end block 121 that remains when the fluid end block is cast or machined. One pipe neck flange 152 may be welded to the end of the fluid end block 121 to provide a flange type connection to the first fluid inlet 122 and another pipe neck flange 152 may be welded to the opposing end of the fluid end block 121 to provide a flange type connection to the second fluid inlet 122. In one option, the outlet bore 126 may be a single continuous linear bore and a pipe neck flange 154 may be welded to either or both ends of the outlet bore 126 to provide a flange type connection to the outlet bore 126. One end of the outlet bore 126 may be closed off with a small cover plate 156 so that all of the outlet fluid will exit through a single pipe neck flange 154. In an alternative option, the outlet bore 126 may be replaced with two blind bores 126 having corresponding bottoms 127, 129 that leave a gap 157 there between. Accordingly, fluids in the two outlet bores 126 do not have any internal fluid communication and mixing is prevented. A pipe neck flange 154 may be welded to both ends of the outlet bore 126 to provide a separate flange type connection to each of the outlet bores 126.

In reference to FIGS. 7A-B, 8A-B, and 9A-B, it is reemphasized that the features of all of these figures are implemented in a single fluid end consistent with the fluid end block 121 shown in FIG. 6.

FIGS. 10A-G are cross-sectional views of several fluid end blocks illustrating the various linear bore configurations that are able to produce output fluid flows having various ratios of first and second fluids according to various embodiments. There are numerous similarities between each of the configures in these Figures. For example, while the number of piston chambers 130 may vary, there is always a one-to-one correspondence of cross bores 140 to piston chambers 130. Furthermore, there are always two inlet bores and each inlet bore extends into communication with at least one cross bore 140 but not all of the cross bores 140. Embodiments may include either one or two outlet bores. Still further, each cross bore 140 will include an inlet valve 18 in the fluid inlet end of the cross bore 140 (i.e., upstream of the piston chamber 130) and an outlet valve 22 in the fluid outlet end of the cross bore 140 (i.e., downstream of the piston chamber 130). Given these similarities, the following discussion of each configuration will focus on the unique aspects of that configuration.

Figure 10A:
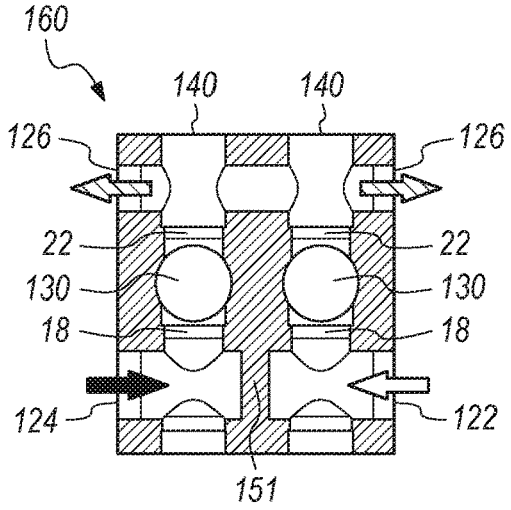
FIGS. 10A-G are cross-sectional views of several fluid end blocks illustrating the various linear bore configurations able to produce output fluid flows having various ratios of first and second fluids according to various embodiments.

FIG. 10A is a cross-sectional view of a fluid end block 160 for a duplex pump according to one embodiment. The fluid end block 160 has two piston chambers 130, one outlet bore 126, and each inlet bore 122, 124 intersects with a single cross bore 140. Accordingly, the fluid end block 160 may receive a first fluid (illustrated with a clear arrow) via the first inlet bore 122 and a second fluid (illustrated with a dark arrow) via the second inlet bore 124 and produce a mixed fluid (illustrate as a cross-hatched arrow) at either or both ends of the outlet bore 126 having a 1:1 ratio of the first and second fluids based on the ratio of piston chambers 130 that receive the first and second fluids, respectively.

Figure 10B:
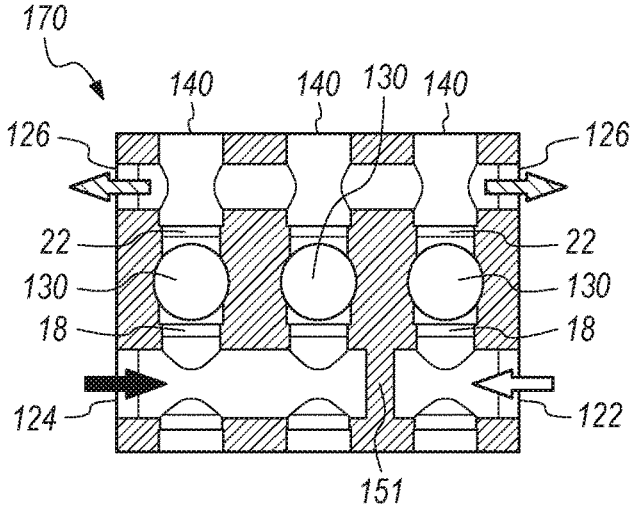

FIG. 10B is a cross-sectional view of a fluid end block 170 for a triplex pump according to one embodiment. The fluid end block 170 has three piston chambers 130, one outlet bore 126, a first inlet bore 122 that intersects with one cross bore 140, and a second inlet bore 124 that intersects with two cross bores 140. Accordingly, the fluid end block 170 may receive a first fluid via the first inlet bore 122 and a second fluid via the second inlet bore 124 and produce a mixed fluid at either or both ends of the outlet bore 126 having a 1:2 ratio of the first and second fluids (i.e., a 2:1 ratio of the second and first fluids) based on the ratio of piston chambers 130 that receive the first and second fluids, respectively.

Figure 10C:
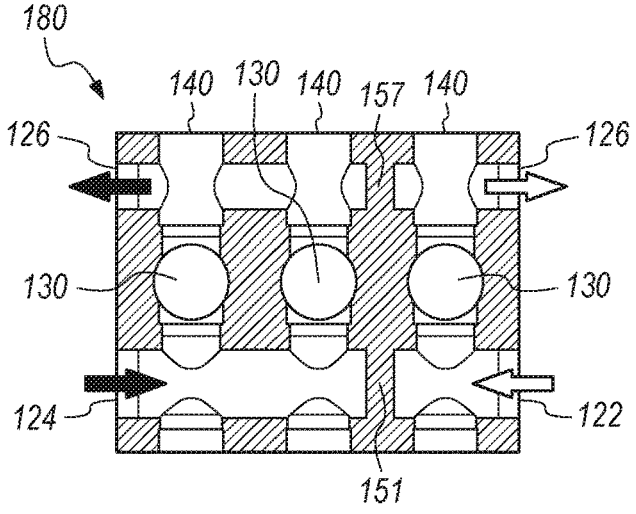

FIG. 10C is a cross-sectional view of the fluid end block 180 for a triplex pump according to one embodiment. The fluid end block 180 has three piston chambers 130, a first outlet bore 126 (on the right) that intersects with one cross bore 140, a second outlet bore 126 (on the left) that intersects with one cross bore 140, a first inlet bore 122 that intersects with one cross bore 140, and a second inlet bore 124 that intersects with two cross bores 140. Accordingly, the fluid end block 180 may receive a first fluid via the first inlet bore 122 and output that first fluid via the first outlet bore 126 (on the right) and a second fluid via the second inlet bore 124 and output that second fluid via the second outlet bore 126 (on the left). While there is no mixed fluid produced within the fluid end block 180, the volume of the first fluid output and the volume of the second fluid output by the fluid end block 180 will have a 1:2 volumetric ratio. Accordingly, if the first and second fluids output via the first and second outlet bores 126 are subsequently mixed, perhaps using a static mixer, then the ratio of the first and second fluids in the mixture would be 1:2 (i.e., a 2:1 ratio of the second and first fluids) based on the ratio of piston chambers 130 that receive the first and second fluids, respectively.

Figure 10D:
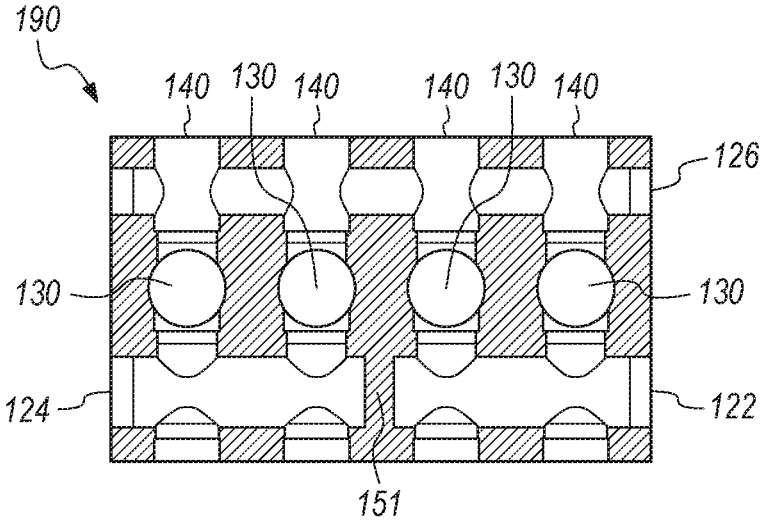

FIG. 10D is a cross-sectional view of a fluid end block 190 for a quadruplex pump according to one embodiment. The fluid end block 190 has four piston chambers 130, four cross bores 140, an outlet bore 126 that intersects with all four cross bores 140, a first inlet bore 122 that intersects with two cross bores 140, and a second inlet bore 124 that intersects with two cross bores 140. Accordingly, the fluid end block 190 may receive a first fluid via the first inlet bore 122 and a second fluid via the second inlet bore 124, and output that the mixed first and second fluids via the outlet bore 126 in either or both directions. The ratio of the first and second fluids in the outlet mixture will be 1:1 based on the ratio of piston chambers 130 that receive the first fluid (i.e., two pistons) and the second fluid (i.e., two pistons), respectively.

Figure 10E:
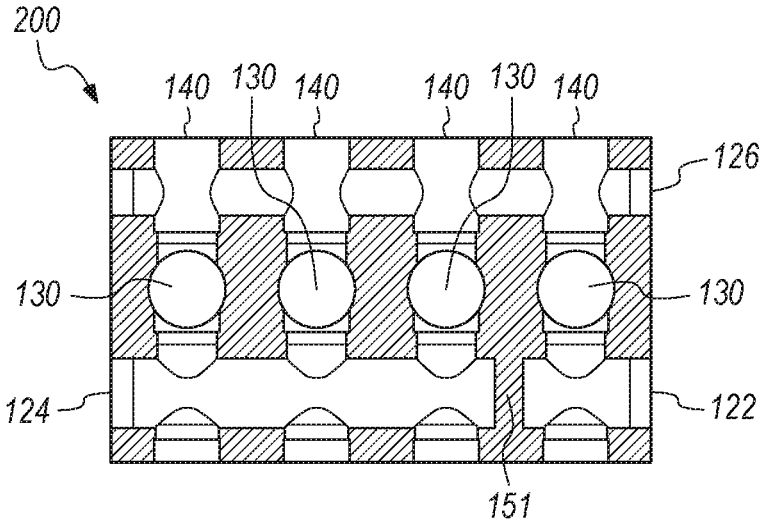

FIG. 10E is a cross-sectional view of a fluid end block 200 for a quadruplex pump according to one embodiment. The fluid end block 200 has four piston chambers 130, four cross bores 140, an outlet bore 126 that intersects with all four cross bores 140, a first inlet bore 122 that intersects with one cross bore 140, and a second inlet bore 124 that intersects with three cross bores 140. Accordingly, the fluid end block 200 may receive a first fluid via the first inlet bore 122 and a second fluid via the second inlet bore 124 and output a mixture of the first and second fluids via the outlet bore 126 in either or both directions. The ratio of the first and second fluids in the outlet mixture will be 1:3 based on the ratio of piston chambers 130 that receive the first fluid (i.e., one piston) and the second fluid (i.e., three pistons), respectively.

Figure 10F:
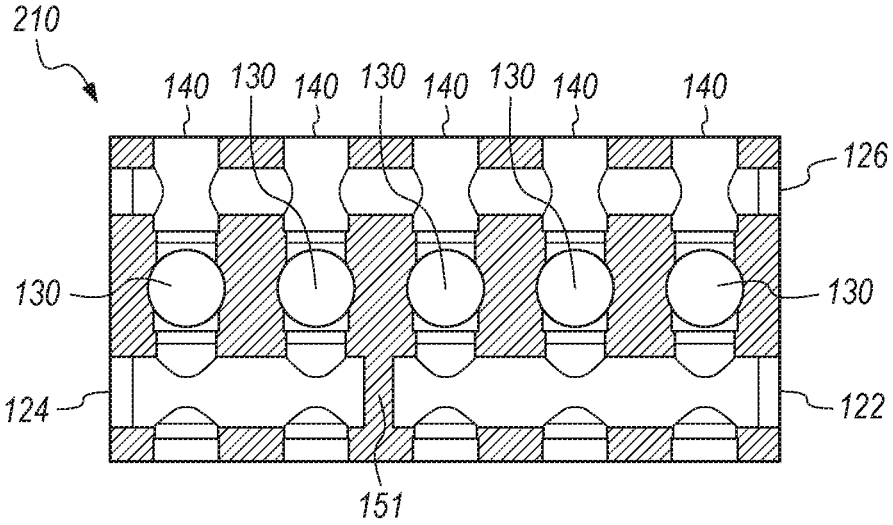

FIG. 10F is a cross-sectional view of a fluid end block 210 for a quintuplex pump according to one embodiment. The fluid end block 210 has five piston chambers 130, five cross bores 140, an outlet bore 126 that intersects with all five cross bores 140, a first inlet bore 122 that intersects with three cross bore 140, and a second inlet bore 124 that intersects with two cross bores 140. Accordingly, the fluid end block 210 may receive a first fluid via the first inlet bore 122 and a second fluid via the second inlet bore 124 and output a mixture of the first and second fluids via the outlet bore 126 in either or both directions. The ratio of the first and second fluids in the outlet mixture will be 3:2 based on the ratio of piston chambers 130 that receive the first fluid (i.e., three pistons) and the second fluid (i.e., two pistons), respectively.

Figure 10G:
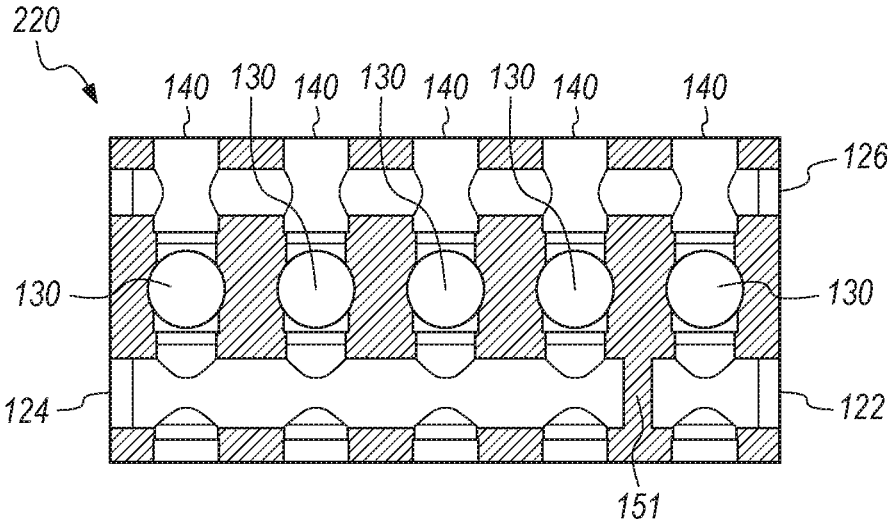

FIG. 10G is a cross-sectional view of a fluid end block 220 for a quintuplex pump according to one embodiment. The fluid end block 220 has five piston chambers 130, five cross bores 140, an outlet bore 126 that intersects with all five cross bores 140, a first inlet bore 122 that intersects with one cross bore 140, and a second inlet bore 124 that intersects with four cross bores 140. Accordingly, the fluid end block 220 may receive a first fluid via the first inlet bore 122 and a second fluid via the second inlet bore 124 and output a mixture of the first and second fluids via the outlet bore 126 in either or both directions. The ratio of the first and second fluids in the outlet mixture will be 1:4 based on the ratio of piston chambers 130 that receive the first fluid (i.e., one piston) and the second fluid (i.e., four pistons), respectively. Clearly, the ratio 1:4 can be considered to be the same as a 4:1 ratio since the first and second fluids may be input to the second and first inlet bores, respectively, or the gap 151 may be repositioned so that the second inlet bore 124 only supplies one piston and the first inlet bore 122 supplies four pistons.

While the option to divide an outlet bore 126 as in FIG. 10B into two separate blind bores was illustrated in FIG. 10C by retaining the portion 157 of the fluid end block, this same option could be implemented in any of the other fluid end blocks of FIG. 10A or 10D-G. Accordingly, these fluid end blocks would have two outlet bores 126 (blind bores) such that the first and second fluids are kept separate (i.e., not mixed within the fluid end block) as the two fluids are pumped from separate inlets and out separate outlets. It is a technical benefit that the two fluid may be pumped at a highly accurate ratio and at flow rates and pressures required by oilfield applications and other applications for which multiplex pumps are designed. Furthermore, while the progression of pump size from the fluid end block 160 for a duplex pump as shown in FIG. 10A to the fluid end blocks 210, 220 for a quadruplex pump as shown in FIGS. 10F-G.

In embodiments that output a mixed fluid via a single outlet bore, the component fluids will begin to mix on the high pressure outlet side of the fluid end block during operation with a pump. In some applications, the mixed fluid may still be passed through a static mixer tube to ensure a fully homogeneous mix of the two fluids. This may be particularly important where the first fluid includes a first component that is reactive with a second component of the second fluid. After pumping a reactive mixture of fluids in the outlet bore, embodiments may include pumping a solvent into both inlet bores and through the outlet bore of the fluid end block before shutting down the pump to ensure that no reactive or reacting chemicals remain within the passages of the fluid end block. Of course, embodiments of the fluid end block make it possible to leave parent material of the fluid end block (i.e., the gaps 151, 157), such as stainless steel, in the both the low pressure inlet bore (i.e., the intake or suction side of the fluid end) and the high pressure outlet bore (i.e., the output or discharge side of the fluid end). The two fluids may be subsequently combined in separate high pressure piping leading to a static mixer. Embodiments of the fluid end block that pump two fluids while keeping them separate provides the technical benefit that if the motive force (i.e., driver, such as an engine or motor) to the pump power end were to fail while pumping reactive fluids, such as a catalyzing epoxy, there would be no risk of having catalyzing epoxy solidify inside the fluid end. Since the fluids would not be mixed until reaching a static mixer, only the static mixer would be at risk of damage due to containing a catalyzing epoxy. The embodiments herein include fluid end blocks with a bifurcated intake bores and optionally bifurcated outlet bores.

Figure 11:
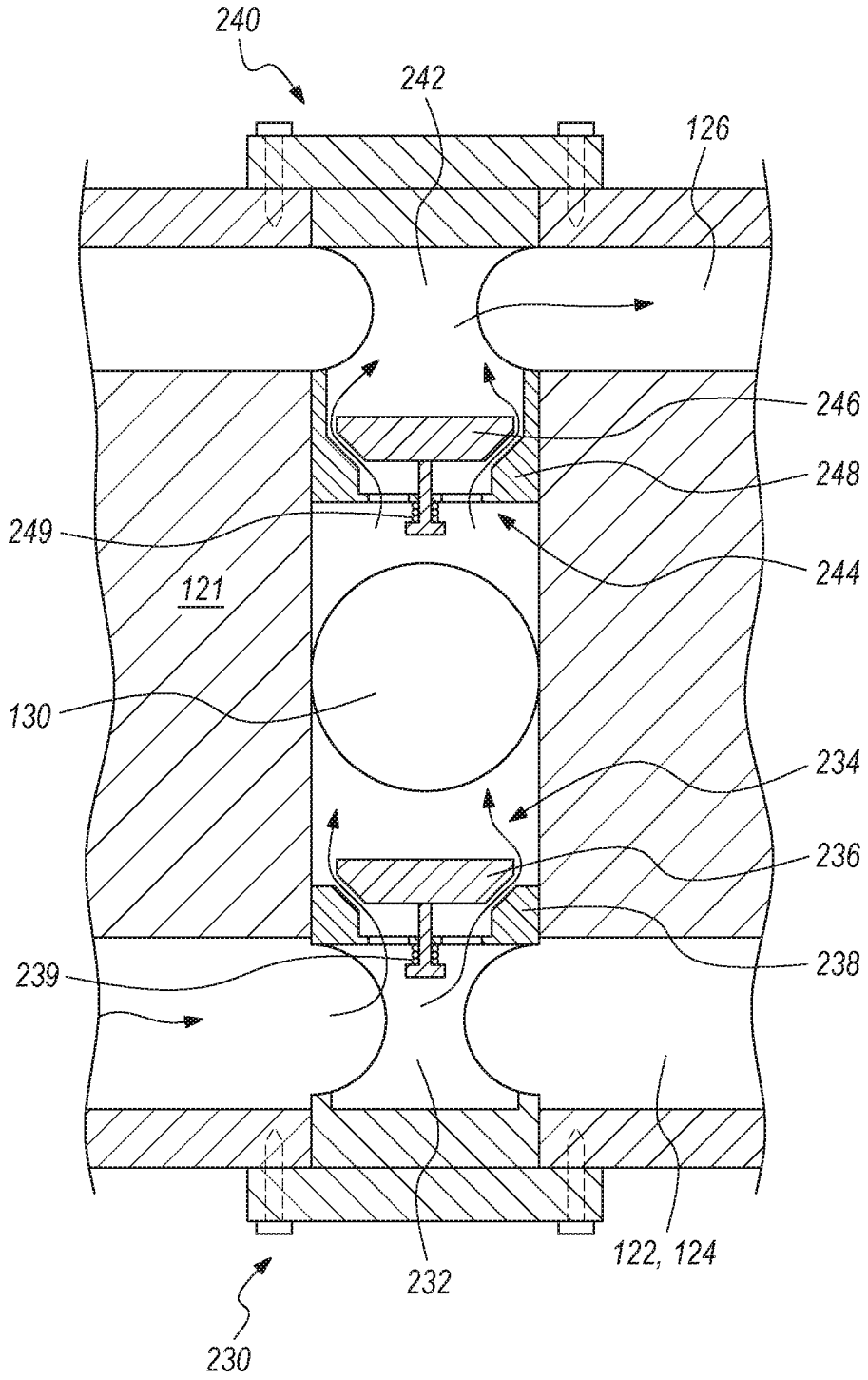
FIG. 11 is a cross-sectional view of fluid end block having an inlet valve assembly that includes a ported sleeve and an outlet valve assembly that includes a ported sleeve according to one embodiment.

FIG. 11 is a partial cross-sectional view of a fluid end block 121 having an inlet valve assembly 230 that includes a ported sleeve 232 and an outlet valve assembly 240 that includes a ported sleeve 242 according to one embodiment. The inlet valve assembly 230 and the outlet valve assembly 240 may have similar construction, except that an orientation of an inlet valve 234 and an outlet valve 244 are reversed relative to the respective ported sleeves 232, 242 but open in the same direction. In other words, the inlet valve assembly 230 is installed in the fluid inlet end of a cross bore 140 from a first side of the fluid end block 121 and the outlet valve assembly 240 is installed in the fluid outlet end of the same cross bore 140 from a second side of the fluid end block 121 opposite the first side. However, in operation, the inlet valve 234 and the outlet valve 244 operate as check valves to only permit fluid flow in one direction from the inlet bore(s) 122, 124 to the outlet bore(s) 126 such that the installed orientation of the inlet valve 234 and the outlet valve 244 must be the same. In operation, only one of the valves 234, 244 will be open at a time. Specifically, during an intake stroke of the piston within the piston chamber 130, the piston creates a suction pressure (low pressure) in the piston chamber that causes the inlet valve 234 to open and the outlet valve 244 to close. Accordingly, fluid from one of the inlet bore 122, 124 will pass through the inlet valve 234 and enter the piston chamber 130. Then, during a discharge stroke of the piston within the piston chamber 130, the piston creates a discharge pressure (high pressure) in the piston chamber that causes the inlet valve 234 to close and the outlet valve 244 to open. Accordingly, fluid from the piston chamber 130 is discharged into the outlet bore 126. These two stroke repeat with each turn of the crankshaft that drives the piston. Embodiments may secure the inlet valve(s) 234 and outlet valve(s) 244 in each cross bore 140 of the fluid end block 121, where the number of cross bores 140 is equal to the number of piston chambers 130, such as two or more but most preferably from 2 to 5.

The inlet valve assembly 230 includes a ported sleeve 232 that is open to the inlet bore 122, 124 and open to the valve 234. During a suction stroke of the piston in the piston chamber 130, the valve disk 236 separates from the valve seat 238 to create an opening through which fluid is allowed to flow. The inlet valve assembly 230 may further include a guide and a spring 239 that biases the disk 236 to return to a seated position after the suction stroke.

Similarly, the outlet valve assembly 240 includes a ported sleeve 242 that is open to the outlet bore 126 and open to the valve 244. During a discharge stroke of the piston in the piston chamber 130, the valve disk 246 separates from the valve seat 248 to create an opening through which fluid is allowed to flow. The outlet valve assembly 240 may further include a guide and a spring 249 that biases the disk 246 to return to a seated position after the discharge stroke.

As will be appreciated by one skilled in the art, embodiments may take the form of a system, method or computer program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a computer program product embodied in one or more computer readable medium(s) having computer readable program code embodied thereon.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. An apparatus, comprising:

a fluid end block;

a first set of multiple linear bores directed through the fluid end block in a primary direction, wherein each of the linear bores in the first set form a piston chamber;

a second set of multiple linear bores directed through the fluid end block in a lateral direction, wherein each of the linear bores in the second set form a cross bore that intersects with one of the piston chambers, and wherein each cross bore has a fluid inlet end and a fluid outlet end;

one or more outlet bores directed into the fluid end block in a longitudinal direction, wherein the fluid outlet end of each cross bore is intersected by one of the one or more outlet bores;

a first inlet bore directed into the fluid end block in the longitudinal direction from a first end of the fluid end block, wherein the first inlet bore is a first blind bore that intersects with the fluid inlet end of a first subset of the cross bores;

a second inlet bore directed into the fluid end block in the longitudinal direction from a second end of the fluid end block that is opposite the first end of the fluid end block, wherein the second inlet bore is a second blind bore that intersects with the fluid inlet end of a second subset of the cross bores, and wherein a portion of the fluid end block separates a bottom end of the first blind bore and a bottom end of the second blind bore;

a plurality of inlet valve assemblies including, for each piston chamber, one of the inlet valve assemblies secured within the fluid inlet end of the cross bore that intersects with the piston chamber to allow one-way fluid flow into the piston chamber; and a plurality of outlet valve assemblies including, for each piston chamber, one of the outlet valve assemblies secured within the fluid outlet end of the cross bore that intersects with the piston chamber to allow one-way fluid flow out of the piston chamber.

2. The apparatus of claim 1, wherein the each of the linear bores in the first set are through-holes, further comprising:

a cover plate secured to the fluid end block to close a first end of the through-holes.

3. The apparatus of claim 1, wherein the each of the linear bores in the second set are through-holes, further comprising:

a first cover plate secured to the fluid end block to close off a first end of the through-holes; and a second cover plate secured to the fluid end block to close off a second end of the through-holes.

4. The apparatus of claim 1, wherein the each of the linear bores in the second set are blind bores having an open end, further comprising:

a first cover plate secured to the fluid end block to close off the open ends of the blind bores in the second set.

5. The apparatus of claim 1, wherein the first inlet bore is axially aligned with the second inlet bore.

6. The apparatus of claim 1, wherein each of the linear bores in the first set are parallel, each of the linear bores in the second set are parallel, and the first and second inlet bores are parallel to the outlet bore.

7. The apparatus of claim 1, wherein the primary direction is perpendicular to the lateral direction, and wherein the longitudinal direction is perpendicular to both the primary direction and the lateral direction.

8. The apparatus of claim 1, wherein the fluid end block is a monolithic piece of metal.

9. The apparatus of claim 8, wherein the first set of multiple linear bores, the second set of multiple linear bores, the outlet bore, the first inlet bore and the second inlet bore have been machined from the fluid end block.

10. The apparatus of claim 1, wherein the first set of multiple linear bores form 2 to 5 piston chambers.

11. The apparatus of claim 1, wherein the number of cross bores formed by the second set of multiple linear bores is equal to the number of piston chambers formed by the first set of multiple linear bores.

12. The apparatus of claim 1, wherein the one or more outlet bores directed into the fluid end block in the longitudinal direction is a single outlet bore intersecting with the fluid outlet end of each of the cross bores.

13. The apparatus of claim 12, wherein the single outlet bore is a blind hole.

14. The apparatus of claim 12, wherein the single outlet bore is a through-hole having a first end and a second end, further comprising a cover plate secured to the fluid end block to close off the first end of the through-hole.

15. The apparatus of claim 1, wherein the one or more outlet bores directed into the fluid end block in a longitudinal direction includes a first outlet bore that intersects with the fluid outlet ends of a third subset of the cross bores and a second outlet bore that intersects with the fluid outlet ends of a fourth subset of the cross bores.

16. The apparatus of claim 15, wherein the third subset of cross bores that intersect with the first outlet bore and the first subset of cross bores that intersect the first inlet bore are the same cross bores, and wherein the fourth subset of cross bores that intersect with the second outlet bore and the second subset of cross bores that intersect the second inlet bore are the same cross bores.

17. The apparatus of claim 1, further comprising:

a plurality of pipe neck flanges, wherein each pipe neck flange includes a pipe segment having a first end secured to the fluid end block and a second end secured to a flange, where the plurality of pipe neck flanges includes a first pipe neck flange forming a connection to the first inlet bore, a second pipe neck flange forming a connection to the second inlet bore, and one or more pipe neck flanges forming a connection to the one or more outlet bores.

18. The apparatus of claim 1, further comprising:

a power end assembly of a pump connected to the fluid end block, wherein the power end assembly includes a crank shaft coupled to a plurality of pistons, wherein each of the pistons is configured to reciprocate within one of the piston chambers to provide an equal stroke volume in response to forced rotation of the crank shaft.

19. The apparatus of claim 18, wherein the first set of multiple linear bores form 2 to 5 piston chambers, and wherein a ratio of a number of the piston chambers in fluid communication with the first inlet bore to a number of the piston chambers in fluid communication with the second inlet bore is selected from 1:1, 2:1, 3:1, 3:2 and 4:1.

20. The apparatus of claim 1, wherein each of the linear bores in the second set are through-holes, and wherein each of the inlet valve assemblies include a ported sleeve having a first end, a second end and a middle portion between the first and second ends, and wherein the first end is connected to a blind flange secured to the fluid end block to close off the fluid inlet end of one of the cross bores, the second end secures an inlet valve in position within the fluid inlet end of the cross bore, and the middle portion is open from the inlet valve to the first or second fluid inlet bore; and wherein each of the outlet valve assemblies include a ported sleeve having a first end, a second end and a middle portion between the first and second ends, and wherein the first end is connected to a blind flange secured to the fluid end block to close off the fluid outlet end of one of the cross bores, the second end secures an outlet valve in position within the fluid outlet end of the cross bore, and the middle portion is open from the outlet valve to one of the one or more fluid outlet bores.

* * * * *